US007841682B2

(12) United States Patent
Yorimoto et al.

(10) Patent No.: US 7,841,682 B2
(45) Date of Patent: Nov. 30, 2010

(54) IMAGE FORMING APPARATUS AND LANDING POSITION ERROR CORRECTION METHOD

(75) Inventors: Mamoru Yorimoto, Tokyo (JP); Kenichi Kawabata, Kanagawa (JP); Takayuki Niihara, Kanagawa (JP); Shinichiro Naruse, Kanagawa (JP); Tetsu Morino, Kanagawa (JP); Takumi Hagiwara, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 12/354,278

(22) Filed: Jan. 15, 2009

(65) Prior Publication Data

US 2009/0184993 A1 Jul. 23, 2009

(30) Foreign Application Priority Data

Jan. 17, 2008 (JP) ..... 2008-008458

(51) Int. Cl.
*B41J 2/01* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | |
|---|---|---|---|
| 2005/0146554 | A1 | 7/2005 | Asanuma et al. |
| 2005/0194730 | A1 | 9/2005 | Nishida et al. |
| 2006/0132574 | A1 | 6/2006 | Kawabata |
| 2006/0146106 | A1 | 7/2006 | Naruse |
| 2006/0209104 | A1 | 9/2006 | Naruse |
| 2006/0268053 | A1 | 11/2006 | Naruse |
| 2007/0035083 | A1 | 2/2007 | Kawabata |
| 2007/0064032 | A1 | 3/2007 | Kawabata |
| 2007/0120936 | A1 | 5/2007 | Kawabata |
| 2007/0126787 | A1 | 6/2007 | Naruse |
| 2008/0122890 | A1 | 5/2008 | Yorimoto |
| 2008/0225066 | A1 | 9/2008 | Yorimoto et al. |
| 2008/0225067 | A1 | 9/2008 | Morino et al. |
| 2008/0225068 | A1 | 9/2008 | Morino et al. |
| 2008/0225098 | A1 | 9/2008 | Hagiwara et al. |
| 2008/0231649 | A1 * | 9/2008 | Kawabata et al. ..... 347/14 |

FOREIGN PATENT DOCUMENTS

| | | |
|---|---|---|
| JP | 4-39041 | 2/1992 |
| JP | 5-249787 | 9/1993 |
| JP | 2004-314361 | 11/2004 |
| JP | 2005-342899 | 12/2005 |
| JP | 2006-178396 | 7/2006 |
| JP | 3838251 | 8/2006 |
| JP | 2007-136942 | 6/2007 |
| JP | 2007-152626 | 6/2007 |

* cited by examiner

*Primary Examiner*—Huan H Tran
(74) *Attorney, Agent, or Firm*—Cooper & Dunham LLP

(57) ABSTRACT

An image forming apparatus includes a carriage carrying a recording head configured to discharge a droplet. A landing position error detecting pattern is formed on a pattern forming member. Based on a result of reading the landing position error detecting pattern, a landing position error of the droplet discharged by the recording head is corrected. Either a first pattern or a second pattern is selected as the landing position error detecting pattern, depending on a surface condition of the pattern forming member. The first pattern produces a relatively small amount of specular reflection compared with diffused reflection, while the second pattern produces a relatively large amount of specular reflection compared with diffused reflection, upon irradiation with light.

12 Claims, 32 Drawing Sheets

$$\{(RK2n-RK1n)-(LK2n-LK1n)\} \times \frac{(RK1n+1-RK1n)}{(LK1n+1-LK1n)}$$

IMAGE FORMING APPARATUS AND LANDING POSITION ERROR CORRECTION METHOD

BACKGROUND OF THE INVENTION

1. Field of the Invention

The present invention generally relates to image forming apparatuses having a recording head capable of discharging a droplet, and methods for correcting a landing position of the droplet discharged by the recording head.

2. Description of the Related Art

There are various types of image forming apparatuses, such as printers, facsimile machines, copy machines, plotters, and multifunction peripherals. One specific example is an inkjet recording apparatus of a liquid discharge recording type. This type of inkjet recording apparatus employs a recording head that discharges ink droplets onto a medium that is transported, in order to form (i.e., record, print, or transfer) an image or the like on the medium.

The term "medium" may refer not only to a sheet of paper but also an OHP (overhead projector) sheet or anything on which a droplet of ink or other liquid can attach. Such medium may be referred to by various names, such as a "recorded medium", a "recording medium", a "recording paper", or a "recording sheet".

There are two types of inkjet recording apparatus. One is called a serial-type image forming apparatus in which the recording head discharges droplets as it moves in a horizontal scan direction to form an image on the medium. The other is called a line-type image forming apparatus which employs a line-type recording head that remains stationary when it discharges droplets to form an image.

The terms "image forming apparatus" in the present disclosure are intended to refer to an apparatus for forming an image by discharging a liquid onto a medium of various material, such as paper, threads, fibers, fabrics, leather, metals, plastics, glass, wood, or ceramics. The terms "image formation" may refer not only to the imparting of an image with some meaning, such as a certain character or figure, onto a medium, but also to the imparting of an image without any meaning, such as a repetitive or random pattern, onto a medium. The term "ink" may refer to various liquids capable of forming an image on a medium, and may be referred to as a "recording fluid", a "fixing solution", and so on.

When a printing operation is carried out in an image forming apparatus of the liquid discharge type, a carriage on which the droplet-discharging recording head is mounted is moved back and forth in the horizontal scan direction in a reciprocal fashion. When characters or the like are printed in both the outward and the homeward directions of the movement of the carriage, a position error tends to be caused in ruled lines that are printed, between the outward path and the homeward path. Another problem is that an overlaid color error tends to be caused when different colors are laid one over another.

Some inkjet recording apparatuses may display a test chart for adjusting the landing position error, so that a user can select optimum values to adjust the discharge timing or the like. However, different users view such a test chart differently. A data input error may also be caused due to lack of experience in such an operation. As a result, the adjustment in the landing position error may actually lead to an increase in the adjustment error.

Japanese Laid-Open Patent Applications No. 4-39041 and 2005-342899, and Japanese Patent No. 3828251 disclose that a test pattern is formed on a transport belt or a medium-retaining transport member and the test pattern is read by a sensor.

Japanese Laid-Open Patent Application No. 2004-314361 discloses that a test pattern is formed on a recording paper and the test pattern is read by a sensor.

Japanese Laid-Open Patent Application No. 2007-152626 discloses that a linear encoder sensor is mounted on the carriage to read a linear encoder as the carriage is moved. Based on an output signal from the linear encoder sensor, the amount of movement of the carriage is measured by a position counter in order to determine a carriage position. Based on the detected carrier position, the landing position of ink droplets discharged out of the recording head on the recording media is shifted in the direction of movement of the carriage.

However, when the test pattern is formed on the transport belt or the medium and read by the sensor, it may be difficult to read the test pattern accurately depending on the combination of the color of the transport belt and that of the ink, such as when the color difference is very small. In order to detect the colors accurately, light sources with different wavelengths for different colors need to be used. In practice, however, such a test pattern formed on the transport belt cannot be read accurately by the conventional art.

For example, a conventional electrostatic adsorption belt is made of an insulating layer on the upper surface and an intermediate-resistance layer on the back surface in which carbon is mixed in order to provide electrical conductivity. In this case, the external color of the belt is black, so that a pattern formed on the belt cannot be distinguished from the black ink, thus failing to detect the pattern.

The present inventors have previously proposed a technology whereby a pattern made of independent ink droplets is formed on a pattern forming member having water repellency. The ink droplets are then irradiated with light of a single wavelength, and the amount of decrease of specular reflection due to the pattern is detected by utilizing the property of the ink droplets to form into hemispherical shapes. In this way, the position of the pattern and its position error are detected accurately.

When a transport belt is used as the water-repellent pattern forming member, for example, the surface condition of the transport belt changes depending on various factors, such as the condition of use and the number of times the pattern has been formed. Thus, the amount of decrease in specular reflection due to the formed pattern cannot be accurately measured when the surface condition of the transport belt is such that there is very little specular reflection therefrom.

SUMMARY OF THE INVENTION

It is a general object of the present invention to provide an image forming apparatus and a landing position error correction method by which one or more of the aforementioned problems of the related art are eliminated.

A more specific object is to form an appropriate pattern on a pattern forming member in accordance with its surface condition, so that the pattern can be read with improved accuracy and a landing position error of a droplet discharged out of a recording head can be corrected with improved accuracy.

According to one aspect of the present invention, an image forming apparatus includes a carriage carrying a recording head configured to discharge a droplet; a pattern forming unit configured to form a landing position error detecting pattern on a pattern forming member; and a reading unit mounted on the carriage and configured to read the landing position error detecting pattern formed on the pattern forming member.

The reading unit includes a light-emitting unit and a light-receiving unit.

The image forming apparatus further includes a landing position error correction unit configured to correct a landing position error of the droplet discharged by the recording head based on a result of reading the landing position error detecting pattern by the reading unit; and a surface condition detection unit configured to detect a surface condition of a region of the pattern forming member where the landing position error detecting pattern is formed, using the pattern reading unit.

The pattern forming unit selects either a first pattern or a second pattern as the landing position error detecting pattern, depending on the surface condition of the pattern-formed region determined by the surface condition detection unit. The first pattern produces a relatively small amount of specular reflection compared with diffused reflection, while the second pattern produces a relatively large amount of specular reflection compared with diffused reflection, upon irradiation with light emitted by the light-emitting unit.

In a preferred embodiment, the surface condition detection unit may cause the reading unit to scan the pattern forming member to determine whether the pattern-formed region is a specular reflection region or a diffused reflection region.

The pattern-formed region is the specular reflection region when the amount of specular reflection received by the light-receiving unit from the pattern-formed region upon irradiation with the light emitted by the light-emitting unit exceeds a predetermined value.

The pattern-formed region is the diffused reflection region when the amount of specular reflection received by the light-receiving unit from the pattern-formed region upon irradiation with the light emitted by the light-emitting unit is below the predetermined value.

In another preferred embodiment, the pattern forming unit may form the first pattern or the second pattern depending on whether the specular reflection region or the diffused reflection region enables the formation of the landing position error detecting pattern with a minimum pattern width.

In another preferred embodiment, the first pattern or the second pattern may be formed depending on whether the pattern-formed region is the specular reflection region or the diffused reflection region.

According to another aspect of the present invention, an image forming apparatus includes a carriage carrying a recording head configured to discharge a droplet; a pattern forming unit configured to form a landing position error detecting pattern on a pattern forming member; and a reading unit mounted on the carriage and configured to read the landing position error detecting pattern on the pattern forming member.

The reading unit includes a light-emitting unit and a light-receiving unit.

The image forming apparatus further includes and a landing position error correction unit configured to correct a landing position error of the droplet discharged by the recording head, based on a result of reading the landing position error detecting pattern by the reading unit.

The pattern forming unit selects either a first pattern or a second pattern as the landing position error detecting pattern depending on whether a predetermined value that correlates with a surface condition of the pattern forming member is exceeded.

The first pattern produces a relatively small amount of specular reflection compared with diffused reflection, while the second pattern produces a relatively large amount of specular reflection compared with diffused reflection, upon irradiation with light emitted by the light-emitting unit.

In a preferred embodiment, the predetermined threshold value that correlates with the surface condition of the pattern forming member may include a number of times the landing position error detecting pattern is formed.

In a preferred embodiment, the predetermined threshold value that correlates with the surface condition of the pattern forming member may include a number of media on which an image is formed by the image forming apparatus.

In a preferred embodiment, the predetermined threshold value that correlates with the surface condition of the pattern forming member may include a duration of time of use of the image forming apparatus.

In another preferred embodiment, the pattern forming member may include a transport belt configured to transport a medium, the predetermined threshold value that correlates with the surface condition of the pattern forming member may include an amount of rotation of the transport belt.

In another preferred embodiment, the first pattern and the second pattern may have the same individual droplet amount and different arrangements.

In another preferred embodiment, the first pattern and the second pattern may have the same arrangement and different individual droplet amounts.

According to another aspect of the present invention, a method for correcting a landing position of a droplet discharged out of a recording head includes the steps of detecting a surface condition of a region of a pattern forming member where a landing position error detecting pattern is formed; and forming a first pattern or a second pattern on the pattern forming member as the landing position error detecting pattern depending on the surface condition of the pattern-formed region of the pattern forming member detected in the detecting step.

The first pattern produces a relatively small amount of specular reflection compared to diffused reflection, while the second pattern produces a relatively large amount of specular reflection compared with diffused reflection, upon irradiation with light.

The method further includes the steps of reading the landing position error detecting pattern formed on the pattern forming member; and correcting a landing position error of the droplet discharged out of the recording head based on a result of reading the landing position error detecting pattern in the reading step.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

In the following, various embodiments of the present invention are described with reference to the drawings.

Figure 1:
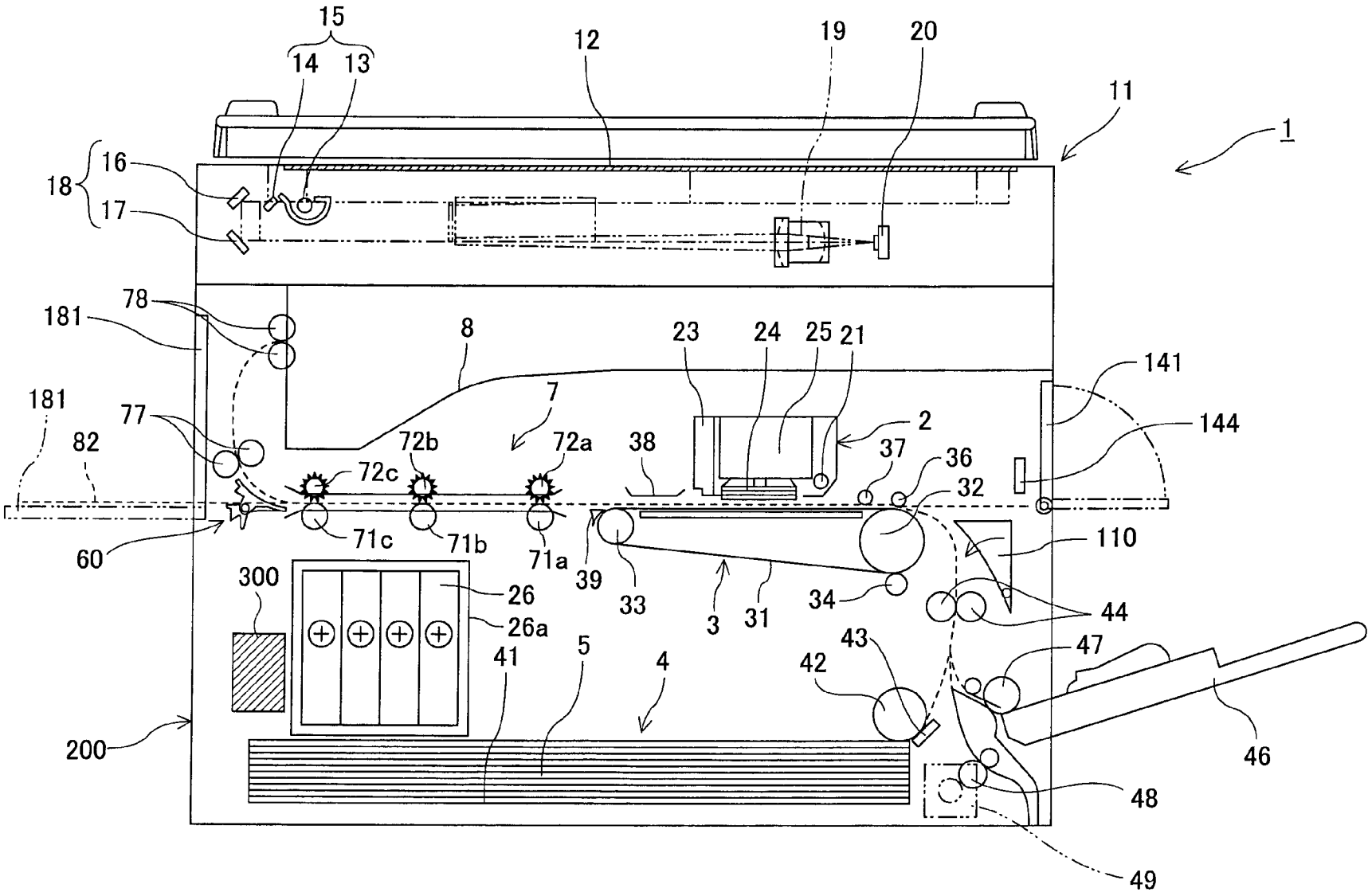
FIG. 1 shows an overall view of an image forming apparatus according to an embodiment of the present invention.
Figure 2:
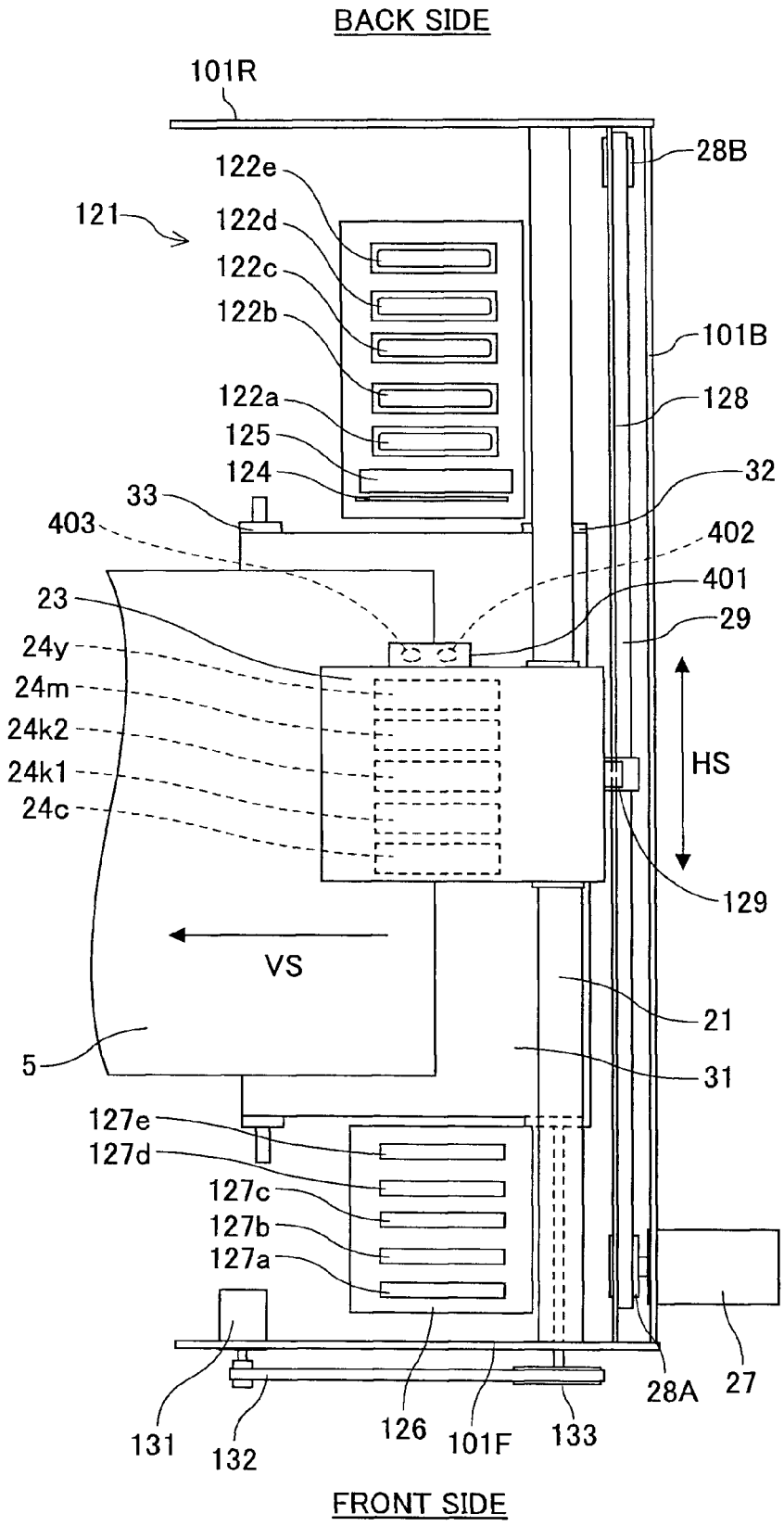
FIG. 2 shows a plan view of an image forming unit and a vertical-scan transport unit of the image forming apparatus of the embodiment shown in FIG. 1.
Figure 3:
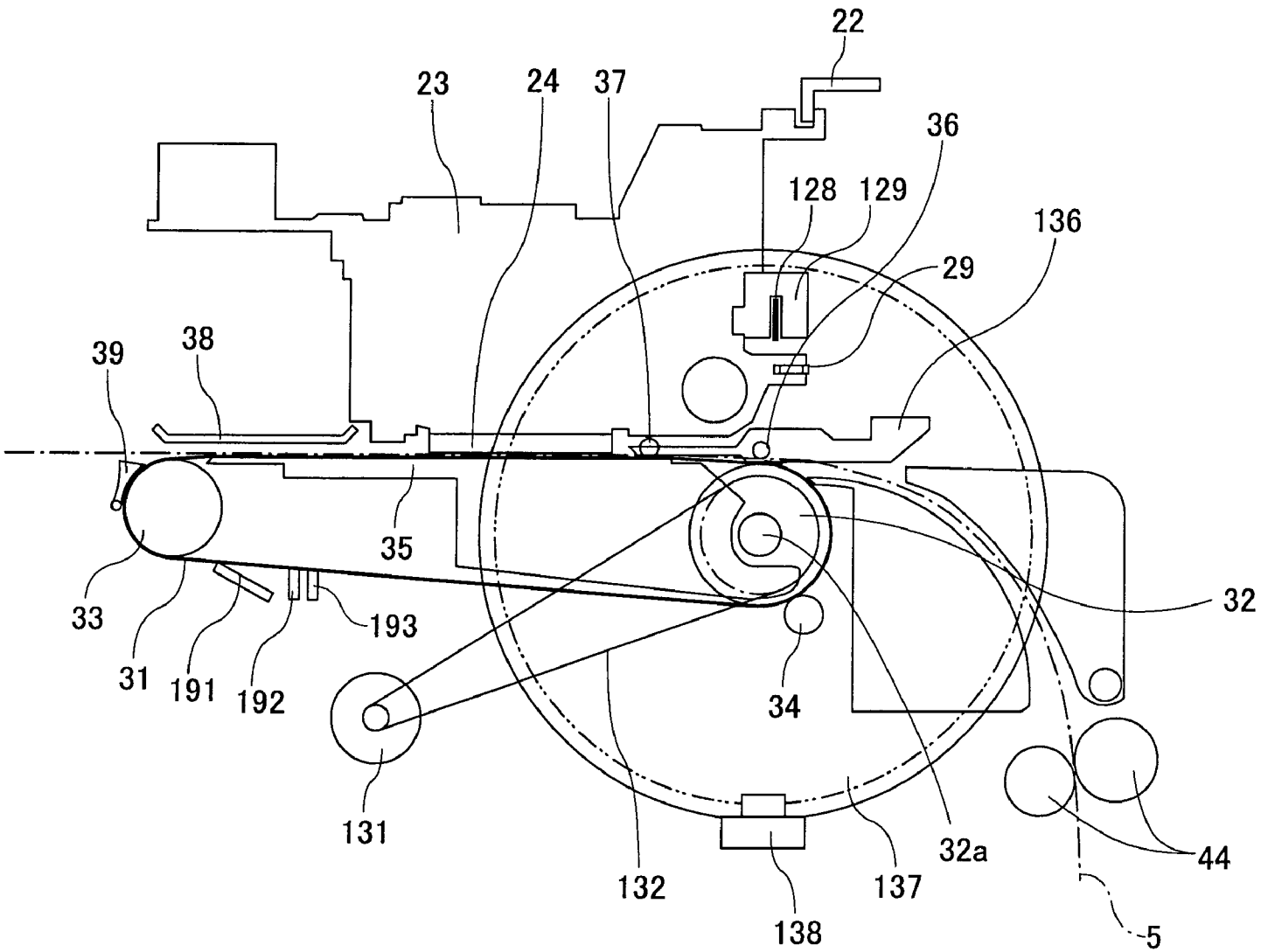
FIG. 3 shows a partially transparent elevational view of the image forming unit and the vertical-scan transport unit of FIG. 2.

With reference to FIGS. 1 through 5, an image forming apparatus 1 for carrying out a landing position error correction method according to an embodiment of the invention is described. FIG. 1 shows the image forming apparatus 1 as a whole. FIG. 2 shows a plan view of an image forming unit 2 and a vertical-scan transport unit 3 of the image forming apparatus 1. FIG. 3 shows a partially transparent lateral view of the image forming apparatus 1.

The image forming apparatus 1 has a main body 20 in which a sheet 5 is fed from a sheet feeding unit 4, which may include a sheet feeding cassette, disposed at the bottom of the main body 200. The sheet 5 is transported by the vertical-scan transport unit 3 and positioned opposite the image forming unit 2, where the image forming unit 2 discharges ink droplets onto the sheet 5 to form a required image thereon. The sheet 5 is then transported by a sheet-ejecting transport unit 7 and ejected onto an ejected sheet tray 8 disposed on top of the apparatus main body 200.

The image forming apparatus 1 includes an image reading unit (such as a scanner) 11 disposed above the ejected sheet tray 8, as an input system for image data (print data) formed by the image forming unit 2. The image reading unit 11 includes a first scan optical system 15 and a second scan optical system 18. The first scan optical system 15 includes an illuminating light source 13 and a mirror 14. The second scan optical system 18 includes mirrors 16 and 17. The first and second scan optical systems 15 and 18 are moved to read an image of a manuscript placed on a contact glass 12. The scanned manuscript image is read by an image reading element 20 disposed behind a lens 19 as an image signal. The image signal is then converted into a digital signal which is then subjected to image processing, and the image-processed print data is printed.

As also shown in FIG. 2, the image forming unit 2 includes a carriage 23 supported by a guide rod 21 and a guide rail (not shown) movably in the horizontal scan direction. The guide rod 21 is a main guide member laterally extended between a front plate 101F and a back plate 101R. The carriage 23 is driven by a horizontal scan motor 27 via a timing belt 29 extended between a drive pulley 28A and a driven pulley 28B to scan the sheet in the horizontal scan direction.

The carriage 23 carries a total of five recording heads 24*k*1, 24*k*2, 24*c*, 24*m*, and 24*y* (which may be collectively referred to as a "recording head 24" when no color distinction is necessary). Each of the recording heads 24*k*1 and 24*k*2 discharges black (K) ink. The recording heads 24*c*, 24*m*, and 24*y* discharge ink droplets of the colors of cyan (C), magenta (M), and yellow (Y), respectively. The carriage 23 is a so-called shuttle type, whereby the ink droplets are discharged out of the recording head 24 as the carriage 23 is moved in the horizontal scan direction while the sheet 5 is moved in the sheet transport direction, i.e., a vertical scan direction, by the vertical-scan transport unit 3 during image formation.

The carriage 23 also carries sub-tanks 25 for supplying recording fluids of required colors to each of the recording heads 24. As shown in FIG. 1, ink cartridges 26 containing inks of the individual colors K, C, M, and Y can be freely attached and detached to and from a cartridge mount unit 26*a* from the front side of the apparatus main body 200. The ink cartridges 26 are connected to the sub-tanks 25 of the individual colors via tubing (not shown) so that the ink (recording fluid) can be supplied from the ink cartridges 26 to the sub-tanks 25. The black ink is supplied from a single ink cartridge 26 to the two of the sub-tanks 25 for black.

The recording head 24 may be of the piezoelectric type that employs a piezoelectric element as a pressure generating unit (actuator) for deforming a vibrating plate forming a wall of an ink channel (pressure generating chamber), in order to change the volume of the ink channel so that ink droplets can be discharged out of the head. Alternatively, the recording head 24 may be of the thermal type, employing a heat-generating resistor to heat the ink in the ink channel so that bubbles can be produced in the channel, the pressure of the bubbles causing the discharge of ink droplets. Further alternatively, the recording head 24 may be of the electrostatic type in which an electrode is disposed opposite a vibrating plate forming a wall surface of an ink channel. The vibrating plate is deformed by the electrostatic force generated between the vibrating plate and the electrode, changing the volume within the ink channel to discharge ink droplets.

Still referring to FIG. 2, between the front plate 101F and the back plate 101R along the horizontal scan direction of the carriage 23, there extends a linear scale 128 having slits. The slits of the linear scale 128 are detected by an encoder sensor 129 attached to the carriage 23 which may include a transmission-type photosensor. The linear scale 128 and the encoder sensor 129 together form a linear encoder for detecting the movement of the carriage 23.

On one side of the carriage 23, there is provided a reading sensor 401 for reading a landing position error detecting pattern (adjusting pattern) according to an embodiment of the present invention. The reading sensor 401 includes a light-emitting unit and a light-receiving unit. The reading sensor 401 may include an optical sensor such as a reflecting-type photosensor. The reading sensor 401 is used to read the surface condition of the transport belt 31 and an adjusting pattern formed on the transport belt 31 for detecting a landing position error, as will be described later.

On the other side of the carriage 23, there is provided a sheet material detection sensor 330 which may be configured to detect the leading edge of a transported sheet member.

In a non-print region on one side of the carriage 23 along the horizontal scan direction, there is provided a maintain/recovery mechanism 121 for the maintenance and recovery of a proper nozzle condition in the recording head 24. The maintain/recovery mechanism 121 includes a humidity-retaining/suction cap 122*a* and four humidity-retaining caps 122*b* through 122*e*. The humidity-retaining/suction cap 122*a* is configured to cap each nozzle surface 24*a* of the five recording heads 24.

The maintain/recovery mechanism 121 also includes a wiper blade 124 for wiping the nozzle surface 24*a* of the recording head 24, and a first blank discharge receiver 125 for a blank discharge operation. In another non-print region on the other side of the carriage 23 along the scan direction, there is provided a second blank discharge receiver 126 for the blank discharge operation. The second blank discharge receiver 126 has openings 127*a* through 127*e*.

The vertical-scan transport unit 3, as shown in FIG. 3, includes a transport roller 32, which is a drive roller, and a driven roller 33, which is a tension roller. An endless transport belt 31 is extended between the transport roller 32 and the driven roller 33 for transporting the sheet 5 opposite the image forming unit 2 after the sheet 5 is fed from below while changing its transport direction by approximately 90°.

A charge roller 34 applies a high alternating voltage from a high-voltage power supply for charging the surface of the transport belt 31. The transport belt 31 is guided by a guide member 35 in a region opposite the image forming unit 2. Pressing rollers 36 and 37 are rotatably retained by a retaining member 136 so that the sheet 5 can be pressed against the transport belt 31 at a position opposite the transport roller 32. The sheet 5 with an image formed thereon by the image forming unit 2 is restricted from above by a guide plate 38. Thereafter, the sheet 5 is separated from the transport belt 31 by a separating nail 39.

The transport belt 31 rotates in the sheet transport direction (vertical scan direction) as the transport roller 32 is rotated by the vertical scan motor 131, which may include a DC brushless motor, via a timing belt 132 and a timing roller 133.

Figure 4:
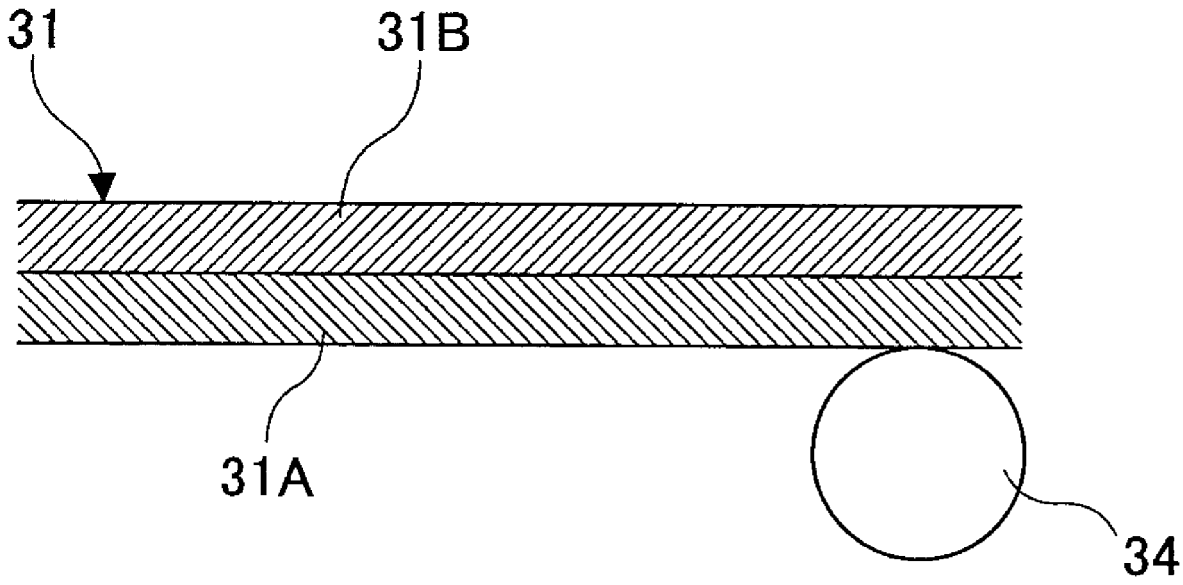
FIG. 4 shows a control system of an example of a transport belt.

The transport belt 31 may have a double-layer structure as shown in FIG. 4, including an upper layer 31A and an underlayer (which may be an intermediate-resistance layer or a ground layer) 31B. The upper layer 31A provides a sheet adsorbing surface and may be made of a pure resin material without resistance control, such as pure ETFE material. The underlayer 31B may be made of the same material as the upper layer 31A with resistance controlled by carbon. The structure of the transport belt 31 is not limited to the above and may have a single-layer structure or structure having three or more layers.

The vertical-scan transport unit 3 also includes a cleaning unit 191, a cleaning brush 192, and a neutralizing brush 193. The cleaning unit 191 is disposed between the driven roller 33 and the, charge roller 34 in contact with the surface of the transport belt 31, so that it can remove paper powder or the like attached to the surface of the transport belt 31 upstream of the transport path of the transport belt 31. The cleaning unit 191 may be made of a PET film or Mylar. The cleaning brush 192 is also in contact with the transport belt 31 surface. The neutralizing brush 193 is used to remove charge on the transport belt 31 surface.

A high-resolution codewheel 137 is attached to a shaft 32*a* of the transport roller 32. The codewheel 137 has slits 137*a* formed therein, which are detected by an encoder sensor 138, which may include a transmission-type photosensor. The codewheel 137 and the encoder sensor 138 form a rotary encoder.

The sheet feeding cassette 41 of the sheet feeding unit 4 is used for stocking a number of sheets 5. The sheet feeding cassette 41 can be attached to or detached from the apparatus main body 200. The sheet feeding unit 4 also includes a sheet-feeding roller 42 and a friction pad 43 for feeding out the sheets 5 in the sheet feeding cassette 41 one by one, and a pair of resist rollers 44 for resisting the sheet 5 that is fed.

The sheet feeding unit 4 further includes a manual feeding tray 46 capable of stocking a number of sheets 5, and a manual feeding roller 47 for feeding the sheets 5 from the manual feeding tray 46 one by one. The sheet feeding unit 4 also includes a vertical transport roller 48 for transporting the sheet 5 that may be fed from another sheet feeding cassette or a both-side unit which may be optionally attached at the bottom of the apparatus main body 200.

These members for feeding the sheet 5 to the vertical-scan transport unit 3, such as the sheet-feeding roller 42, the resist rollers 44, the manual feeding roller 47, and the vertical transport roller 48, are driven by a sheet feeding motor 49 which may include an HB-type stepping motor, via an electromagnetic clutch which is not shown.

The sheet-ejecting transport unit 7 includes three transport rollers 71*a*, 71*b*, and 71*c* (which may be collectively referred to as a "transport roller 71") for transporting the sheet 5 after it is separated from the belt by the separating nail 39 in the vertical-scan transport unit 3. The sheet-ejecting transport unit 7 also includes opposite spurs 72*a*, 72*b*, and 72*c* (which may also be collectively referred to as a "spur 72"). The sheet 5 is finally flipped and ejected onto the ejected sheet tray 8 face-down by a pair of flipping rollers 77 and a pair of flipping/sheet-ejecting rollers 78.

In order to perform the single-sheet manual feeding, a single manual sheet feeding tray 141 is provided on one side of the apparatus main body 200, as shown in FIG. 1. The single manual sheet feeding tray 141 is opened to a position indicated by a virtual line in FIG. 1 when the single-sheet manual feeding is performed. The sheet 5 that is manually fed via the single manual sheet feeding tray 141 can be guided on top of the guide plate 110 and linearly inserted between the transport roller 32 and the pressing roller 36 of the vertical-scan transport unit 3.

After image formation, in order to allow the sheet 5 to be linearly ejected face-up, a straight ejected sheet tray 181 is provided on the other side of the apparatus main body 200. By opening the straight ejected sheet tray 181 as shown by the dotted lines, the sheet 5 as it is transported from the sheet-ejecting transport unit 7 can be linearly ejected onto the straight ejected sheet tray 181.

Figure 5:
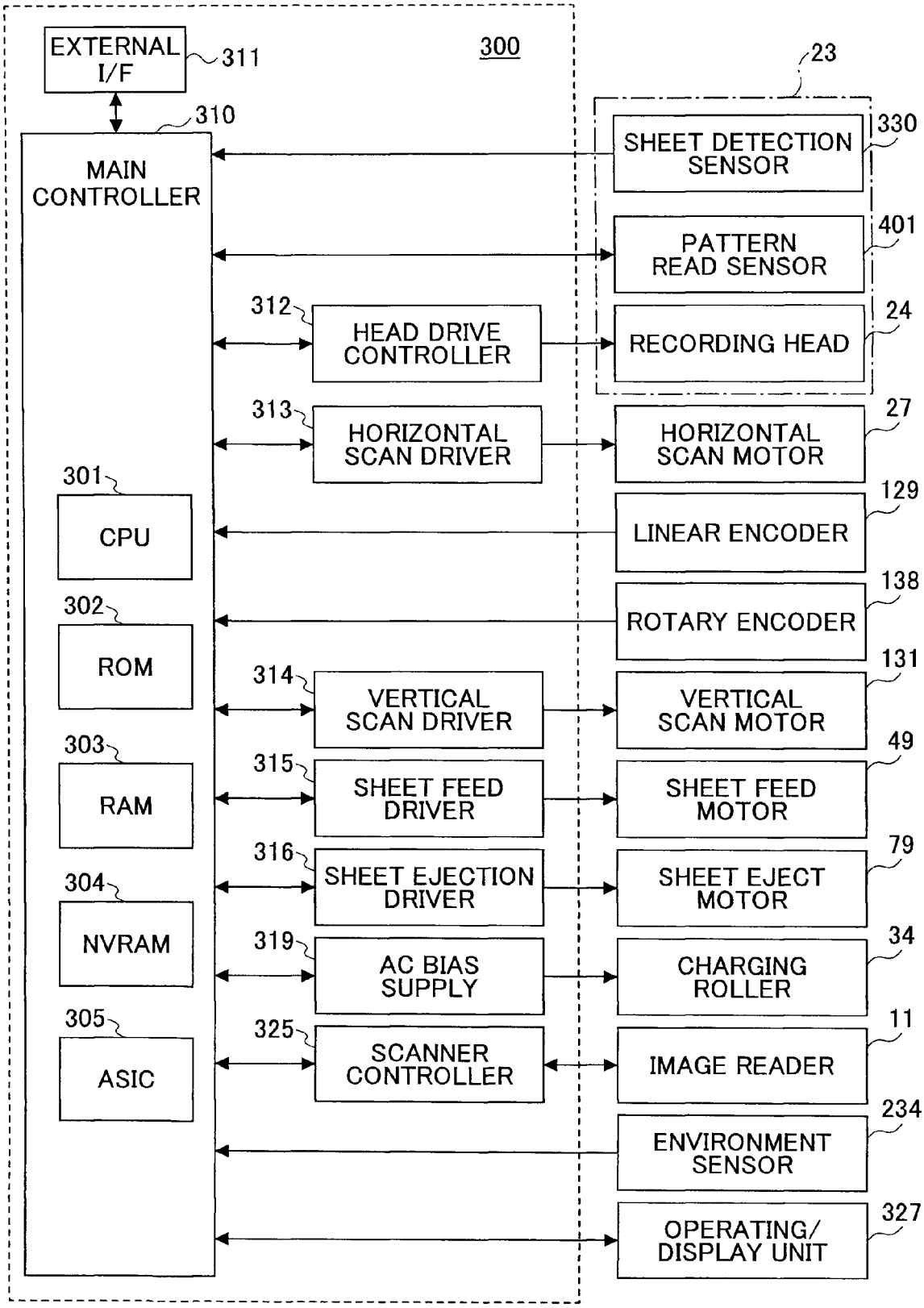
FIG. 5 shows a block diagram of a control unit of the image forming apparatus of the embodiment shown in FIG. 1.

With reference to a block diagram shown in FIG. 5, a control unit 300 of the image forming apparatus is described.

The control unit 300 includes a main control unit 310 for controlling the apparatus as a whole, the formation and detection of an adjusting pattern, and the landing position adjustment (correction).

The main control unit 310 includes a central processing unit (CPU) 301; a read-only memory (ROM) 302 storing a program executed by the CPU 301 and other fixed data; a random access memory (RAM) 303 for the temporary storage of image data or the like; a nonvolatile random access memory (NVRAM) 304 capable of retaining data when the power supply to the apparatus is turned off; and an application specific integrated circuit (ASIC) 305 for various signal processing on image data, such as image-rearranging processing, and for processing of input/output signals for controlling the apparatus as a whole.

The control unit 300 further includes an external interface (I/F) 311 between a host and the main control unit 310 for the reception and transmission of data or signals; and a head drive control unit 312 including a head driver (which is actually provided at the recording head 24 end), which may include an ASIC for transforming the sequence of generation of head data for driving and controlling the recording head 24.

The control unit 300 also includes a horizontal scan drive unit 313 for driving the horizontal scan motor 27 that moves the carriage 23; a vertical scan drive unit 314 for driving the vertical scan motor 131; a sheet-feed drive unit 315 for driving the sheet feeding motor 49; a sheet ejection drive unit 316 for driving the sheet ejection motor 79 that drives the rollers in the sheet ejection unit 7; an AC bias supply unit 319 for supplying an AC bias to the charging belt 34; and a scanner control unit 325 for controlling an image reading unit 11.

The control unit 300 may further include various units that are not shown, such as a recovery system drive unit for driving a maintain/recovery motor (not shown) that drives the maintain/recovery mechanism 121; a both-side drive unit for driving a both-side unit (not shown) when it is installed; a solenoids drive unit for driving various solenoids not shown; and a clutch drive unit for driving electromagnetic clutches and the like which are not shown.

The main control unit 310 receives various detection signals from sensors such as an environment sensor 234 that detects the temperature and humidity (i.e., environment conditions) around the transport belt 31. The main control unit 310 may also receive other detection signals from other sensors which are not shown. The main control unit 310 also receives necessary key inputs from, and outputs various display information to, an operating/display unit 327 on the apparatus main body 200 that may include various keys such as a numeric keypad and a print start key as well as various display units.

The main control unit 310 further receives an output signal from the aforementioned photosensor (encoder sensor) 129 that detects the carriage position. Based on the output signal, the main control unit 310 controls the vertical scan motor 27 via the horizontal scan drive unit 315 so that the carriage 23 can be moved back and forth in the horizontal scan direction.

The main control unit 310 also receives an output signal (pulse) from the aforementioned photosensor (encoder sensor) 138 that detects the amount of movement of the transport belt 31. Based on this output signal, the main control unit 310 controls the vertical scan motor 131 via the vertical scan drive unit 314 so that the transport belt 31 can be moved via the transport roller 32.

The main control unit 310 performs a process to detect the surface condition of the transport belt 31 using the reading sensor 401. Based on the detected surface condition, the main control unit 310 performs a process of forming an adjusting pattern on the transport belt 31. The main control unit 310 then performs a light-emitting drive control by which the light-emitting unit in the reading sensor 401 mounted on the carriage 23 is caused to emit light against the adjusting pattern.

The adjusting pattern is then read via an output signal from the light-receiving unit, and a landing position error amount is detected based on the output signal. Based on the landing position error amount, the main control unit 310 corrects the droplet discharge timing of the recording head 24 so that the landing position error can be eliminated, as will be described in detail below.

An image formation operation in the thus structured image forming apparatuses is briefly described below. The amount of rotation of the transport roller 32 that drives the transport belt 31 is detected. Based on the detected rotation amount, the vertical scan motor 131 is controlled while the AC bias supply unit 319 applies a high positive-negative alternating voltage of a square waveform to the charge roller 34. Thus, positive and negative charges are applied to the transport belt 31 in the form of bands alternating along the transport direction of the transport belt 31. Thus, the transport belt 31 is charged with predetermined charge widths, creating a non-uniform electric field.

As the sheet 5 fed from the sheet feeding unit 4 is sent between the transport roller 32 and the first pressing rollers 36 and further onto the transport belt 31 where the non-uniform electric field is present, the sheet 5 instantaneously polarizes in accordance with the direction of the electric field As a result, the sheet 5 is adsorbed on the transport belt 31 by an electrostatic adsorption force, and transported with the transport belt 31.

The sheet 5 is transported on the transport belt 31 in an intermittent manner while the carriage 23 is moved in the horizontal scan direction. When the sheet 5 is stationary, the recording head 24 discharges droplets of a recording fluid in order to record (print) an image on the sheet 5. The leading edge of the printed sheet 5 is then separated from the transport belt 31 by the separating nail 39, and the sheet 5 is sent to the sheet-ejecting transport unit 6. Thereafter, the sheet 5 is ejected onto the ejected sheet tray 7.

During a print (recording) standby period, the carriage 23 is moved toward the maintain/recovery mechanism 121, where the nozzle surface of the recording head 24 is capped by the cap 122. In this way, the nozzle can maintain its humid condition, and a discharge failure due to dried ink can be prevented. Also, with the recording head 24 capped with the suction/humidity-retaining cap 122*a*, the recording fluid may be sucked out of the nozzle in a recovery operation, so that the thickened recording fluid or air bubbles can be ejected.

During the recovery operation, the recording head 24 may be wiped with the wiper blade 124 in order to remove ink attached to the nozzle surface. When a blank discharge operation is performed, the ink that is irrelevant to a recording process is discharged toward the blank discharge receiver 125 at the start or during the recording process. In this way, stable discharge performance of the recording head 24 can be maintained.

Figure 6:
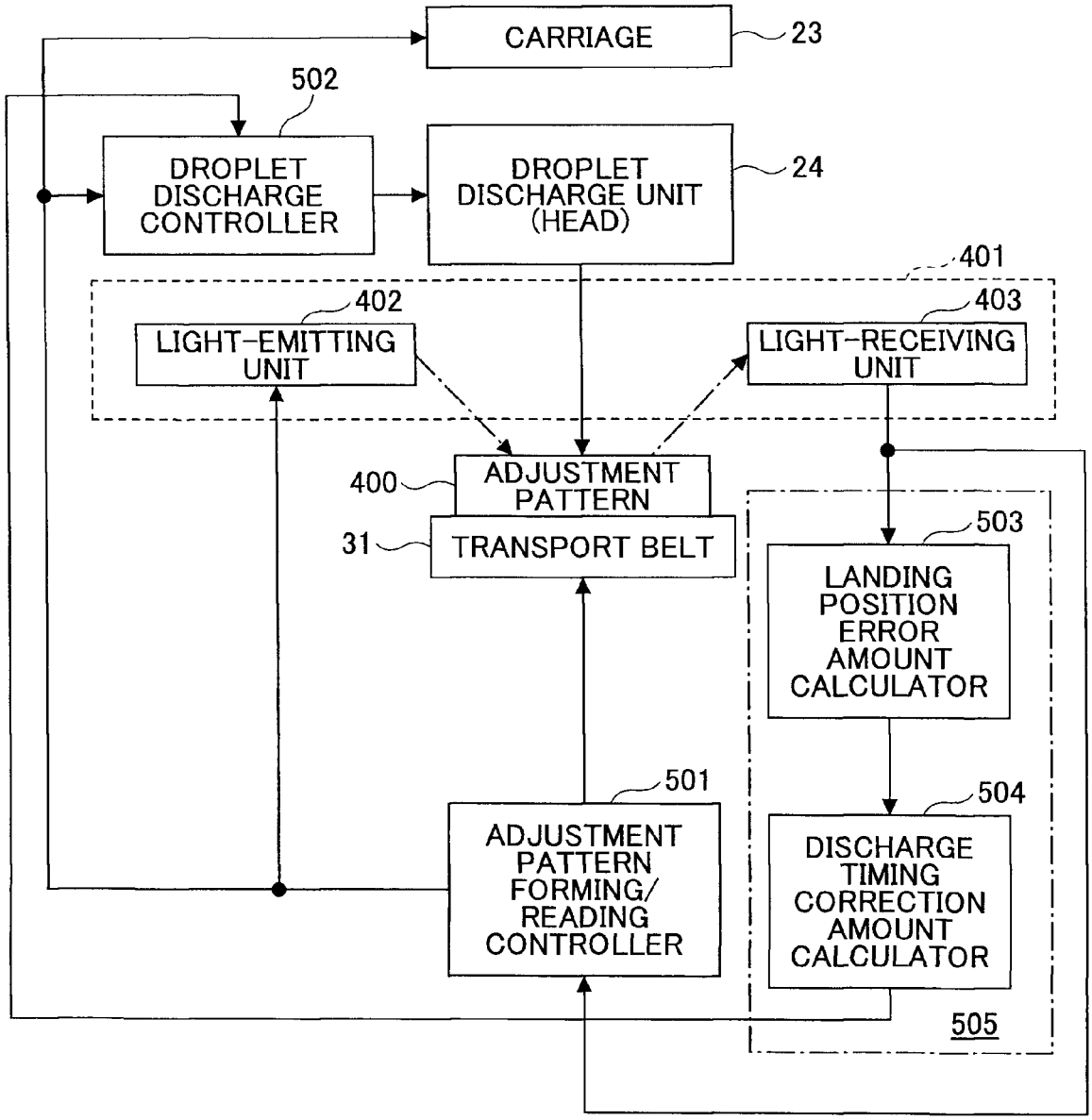
FIG. 6 shows a functional block diagram of portions of the image forming apparatus that relate to the droplet landing position detection and droplet landing position correction functions.
Figure 7A:
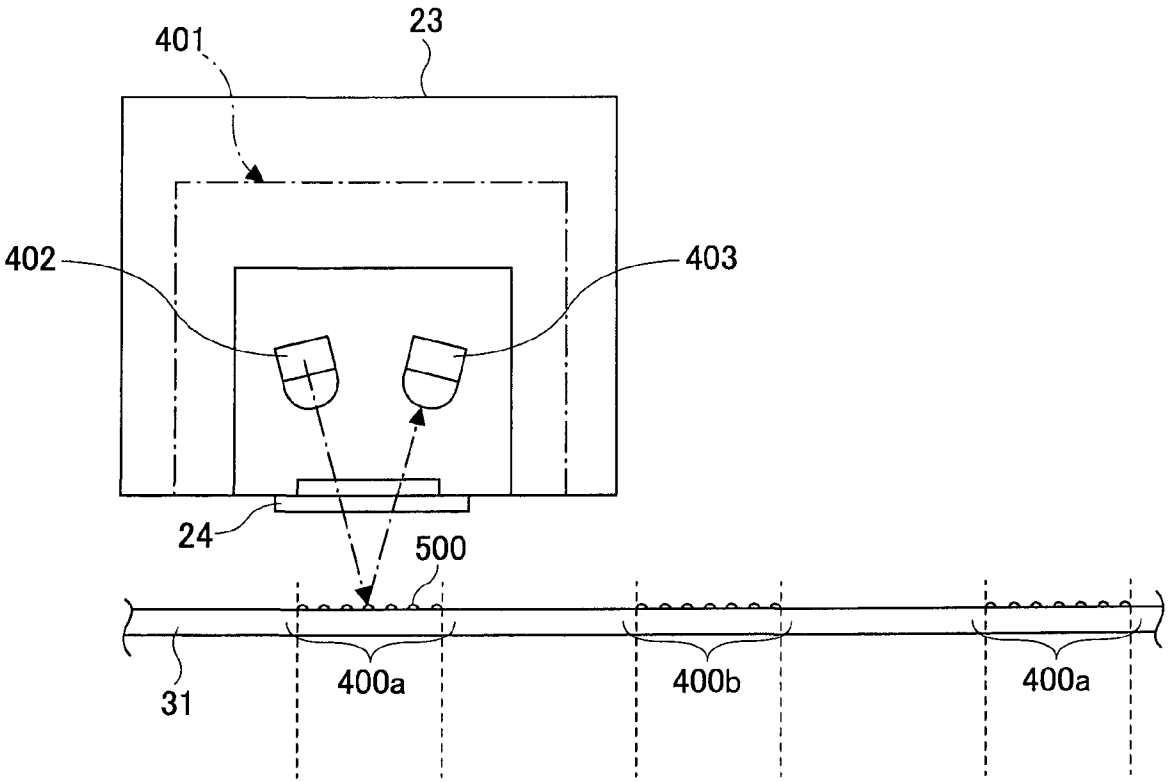
FIG. 7A shows a reading sensor and patterns formed on the pattern forming member that are read by the reading sensor.
Figure 7B:
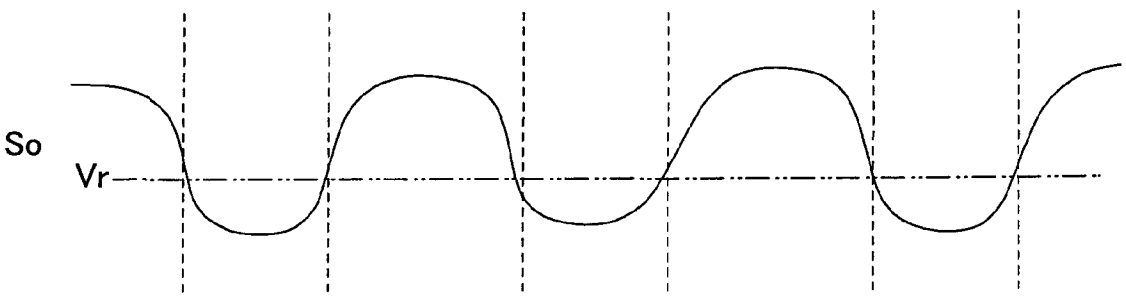
FIG. 7B shows a sensor output voltage.

With reference to FIGS. 6 and 7, a droplet landing position error correction control process performed in the image forming apparatus is described. FIG. 6 shows a functional block diagram of a droplet landing position error correction portion of the apparatus 1. FIGS. 7A and 7B illustrate a droplet landing position error correction operation.

Figure 8:
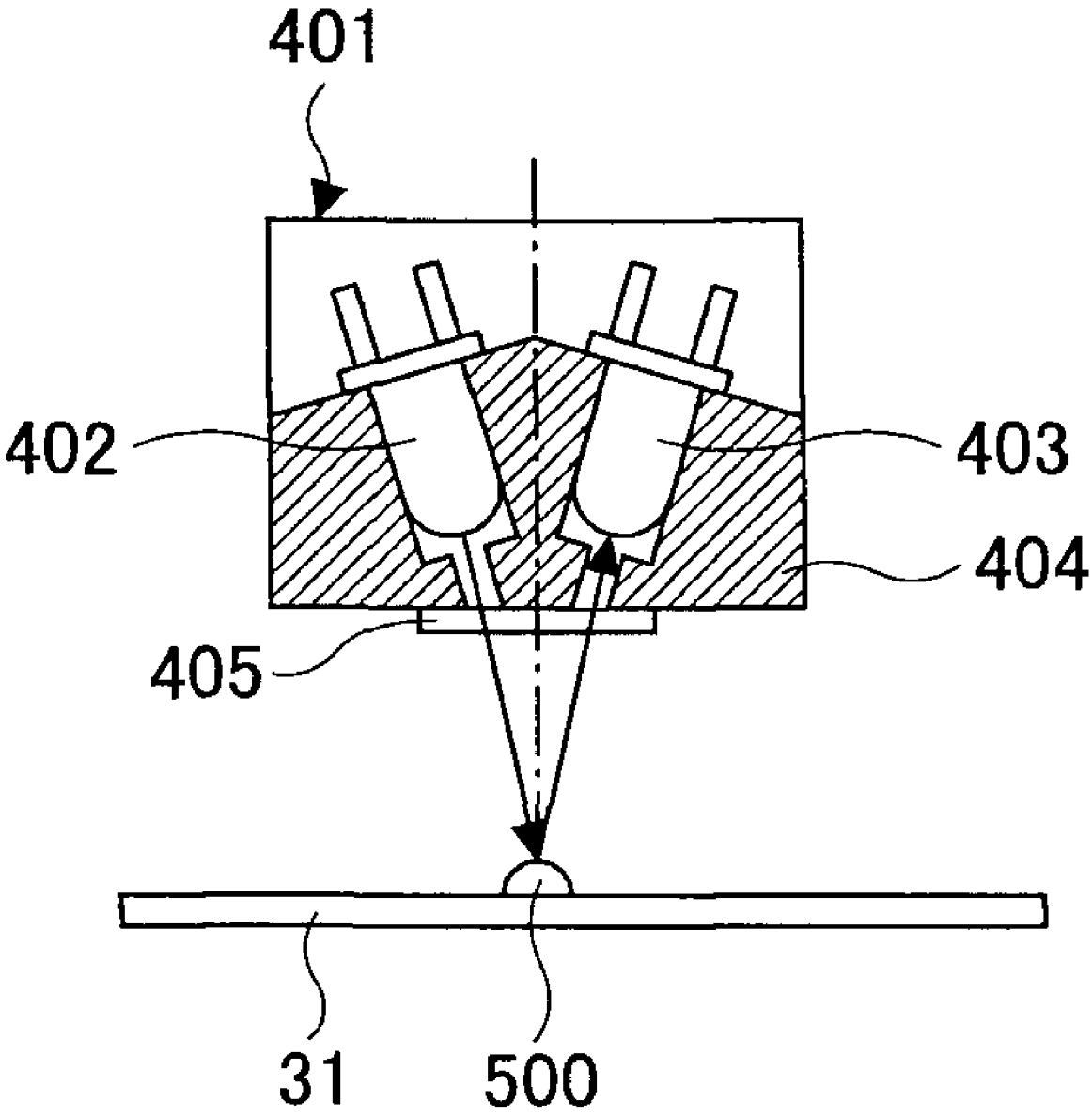
FIG. 8 shows an example of the reading sensor.

As shown in FIG. 7A and also in FIG. 8, the carriage 23 carries the reading sensor 401 for detecting a landing position error detection pattern (which may also be referred to as an "adjusting pattern", a "test pattern", or simply a "detection pattern") 400 formed on the transport belt 31, which is a water-repellent pattern forming member. The adjusting pattern 400 includes at least a reference pattern 400*a* and a measured pattern 400*b*, as shown in FIG. 7A.

The reading sensor 401 is made up of a single packaging of the light-emitting element 402 and the light-receiving element 403 that are retained on a holder 404. The light-emitting element 402 emits light toward the adjusting pattern 400 that is arranged on the transport belt 31 in a direction perpendicular to the horizontal scan direction. The light-receiving element 403 receives specular reflection from the adjusting pattern 400. A lens 405 is provided at the light entry/exit portion of the holder 404.

As shown in FIG. 2, the light-emitting element 402 and the light-receiving element 403 are arranged in a direction perpendicular to the scan direction of the carriage 23. Thus, the influence of the moving speed variation of the carriage 23 on the detection result can be reduced.

The light-emitting element 402 may include a relatively simple and inexpensive light source, such as a light-emitting diode (LED), and may emit light in the infrared or visible spectrum region. The spot diameter (i.e., the range or region of detection) of the light source may be on the order of millimeters because the light source does not require a high-accuracy, expensive lens.

The adjusting pattern formation/read control unit 501 moves the carriage 23 in the horizontal scan direction to read the surface condition of the transport belt 31 at a position where the adjusting pattern 400 is to be formed ("pattern formation region") using the reading sensor 401. Then, the adjusting pattern formation/read control unit 501 causes the recording head 24 to discharge ink droplets so that lines of the reference pattern 400*a* and the measured pattern 400*b* (of which the adjusting pattern 400 is made) are formed in the pattern formation region on the transport belt 31.

The adjusting pattern 400 may include either a first pattern or a second pattern, depending on the surface condition of the pattern-formed position. The first pattern produces less specular reflection than diffused reflection. The second pattern produces more specular reflection than diffused reflection. The example of FIG. 7A employs the first pattern made up of plural independent droplets 500.

The adjusting pattern formation/read control unit 501 also performs an adjusting pattern read control operation to read the adjusting pattern 400 on the transport belt 31 using the reading sensor 401. Specifically, in the adjusting pattern read control operation, the light-emitting element 402 of the reading sensor 401 emits light with which the adjusting pattern 400 on the transport belt 31 is irradiated while the carriage 23 is moved in the horizontal scan direction.

As the adjusting pattern 400 on the transport belt 31 is thus irradiated with the emitted light from the light-emitting element 402, specular reflection from the adjusting pattern 400 becomes incident on the light-receiving element 403. The light-receiving element 403 outputs a detection signal in accordance with the received amount of the specular reflection from the adjusting pattern 400. The detection signal is input to the landing position error amount calculating unit 503 of the landing position correcting unit 505.

Based on the output result from the light-receiving element 403, the landing position error amount calculating unit 503 calculates the distances between the patterns 400*a* and 400*b* based on the time between the patterns 400*a*, the time between the patterns 400*a* and 400*b*, and the moving speed of the carriage 23.

The calculated distance between the patterns 400*a* and 400*b* is then corrected based on the calculated distance between the patterns 400*a* and the theoretical distance between the patterns 400*a*. In this way, an error amount (droplet landing position error amount) of the measured pattern 400*b* with respect to the reference positions is calculated.

The landing position error amount calculated by the landing position error amount calculating unit 503 is supplied to the discharge timing correction amount calculating unit 504. The discharge timing correction amount calculating unit 504 calculates a correction amount for the discharge timing of the recording head 24 such that the landing position error amount can be eliminated. The correction amount is then set in the droplet discharge control unit 502, by which the recording head 24 is controlled. Thus, the droplet discharge control unit 502 drives the recording head 24 in accordance with the discharge timing corrected by the correction amount, so that the droplet landing position error can be reduced.

The formation of the adjusting pattern 400 and its detection principle are described with reference to FIGS. 9 through 15.

Figure 9A:
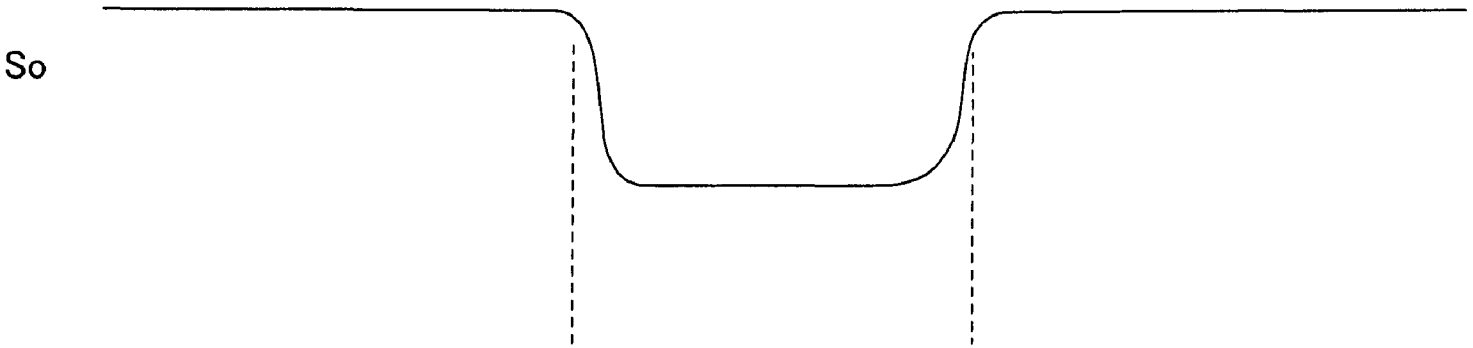
FIG. 9A shows a sensor output obtained from a first pattern formed on the transport belt as shown in FIG. 9B.
Figure 9B:
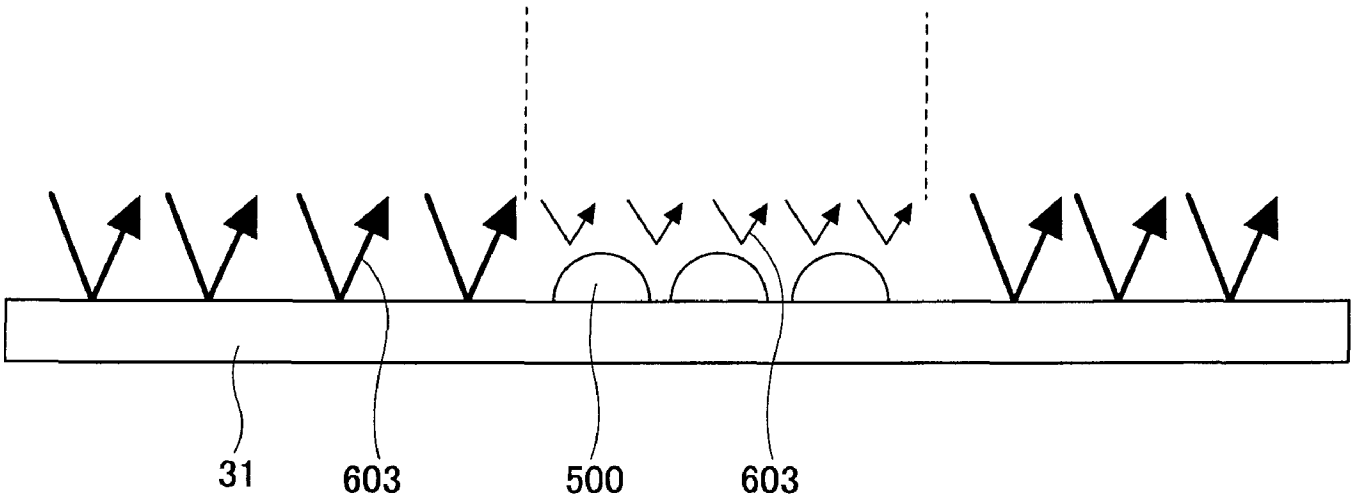

With reference to FIGS. 9A and 9B, when the surface of the transport belt 31 (belt surface) is lustrous and easily produces specular reflection upon being irradiated with the light from the light-emitting element 401, the adjusting pattern 400 is formed of plural independent ink droplets 500 on the transport belt 31, as shown in FIG. 9B (it is noted that the ink droplets 500 are hemispherical when landed).

Figure 13:
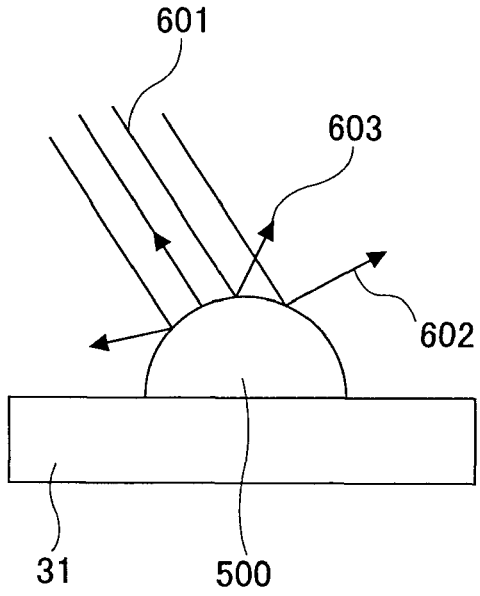
FIG. 13 illustrates how light is diffused by a droplet.

FIG. 13 shows one of such ink droplets 500. When incident light 601 from the light-emitting element 402 hits the ink droplet 500, because the ink droplet 500 has a round, lustrous surface, most of the incident light 601 is turned into diffused reflection 602, and only a little amount is detected as specular reflection 603.

As a result, when the transport belt 31 with the pattern 400 consisting of such independent plural ink droplets 500 formed thereon is scanned with the light from the light-emitting element 402, the light is diffused by the hemispherical and lustrous surface of the ink droplets 500. Thus, the amount of the specular reflection 603 at the pattern 400 is reduced, resulting in a smaller output (sensor output voltage So) of the light-receiving element 403 receiving the specular reflection 603.

Thus, based on the sensor output voltage So of the reading sensor 401, the position of the adjusting pattern 400 formed on the transport belt 31 can be detected.

Figures 10A, 10B:
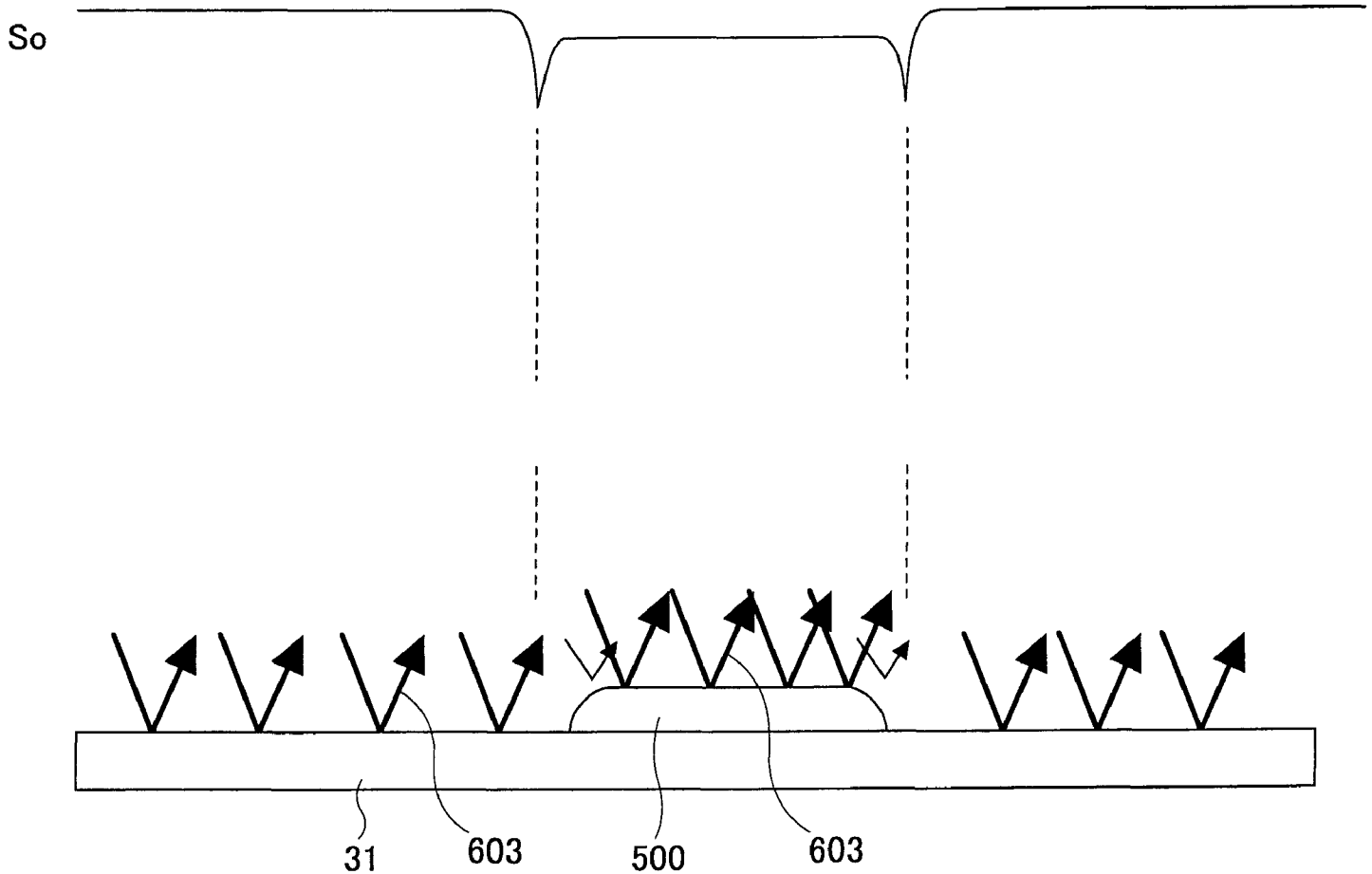
FIG. 10A shows a sensor output obtained from another pattern on the transport belt as shown in FIG. 10B.

With reference to FIGS. 10A and 10B, another case is considered in which the surface of the transport belt 31 is lustrous and easily produces specular reflection upon being irradiated with the light from the light-emitting element 401. If the ink droplets come into contact with each other and are merged on the transport belt 31, as shown in FIG. 10B, the upper surface of the merged ink 500 becomes flat. As a result, the specular reflection 603 increases so much that the sensor output voltage So may be roughly the same as the output value from the transport belt 31 surface, making it difficult to detect the position of the ink droplets 500.

Even when the ink droplets are merged, scattered light is produced at their edges as indicated by the smaller arrows. However, such edge areas are very limited and cannot be easily detected. If they were to be detected, the area or region covered or detected by the light-receiving element 403 would have to be narrowed so much that even the slightest scratch, dust, or other noise factors on the transport belt surface would be detected. This would lead to a decrease in detection accuracy or the reliability of the detection result.

Figure 11A:
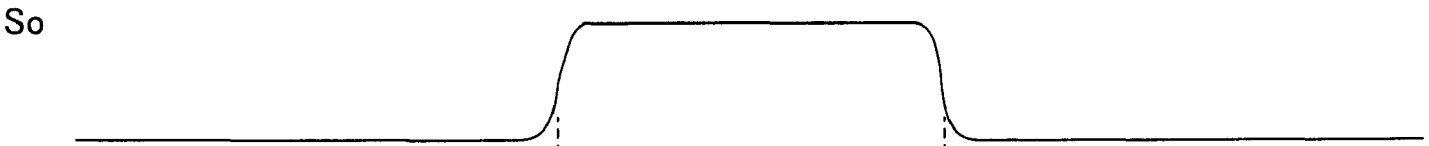
FIG. 11A shows a sensor output obtained from another pattern formed on the transport belt as shown in FIG. 11B.
Figure 11B:
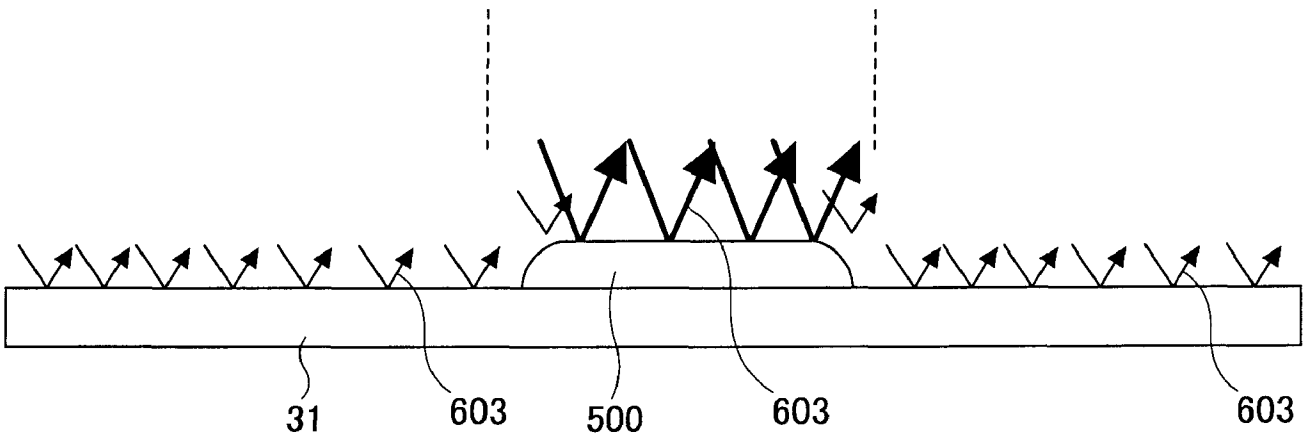

With reference to FIGS. 11A and 11B, another case is considered in which the luster of the transport belt 31 surface is reduced so that specular reflection is not readily produced, but rather diffused reflection is readily produced, upon being irradiated with the light from the light-emitting element 401.

In this case, if the ink droplets merge on the transport belt 31 and form the adjusting pattern 400 with a flat surface as shown in FIG. 11B, the specular reflection 603 from the adjusting pattern 400 increases as mentioned above, while the amount of specular reflection from the transport belt surface is reduced. Thus, based on the sensor output voltage So from the reading sensor 401, the position of the adjusting pattern 400 formed on the transport belt 31 can be detected.

Figure 12A:
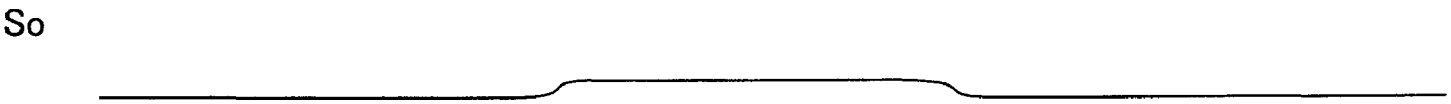
FIG. 12A shows a sensor output obtained from another pattern formed on the transport belt as shown in FIG. 12B.
Figure 12B:
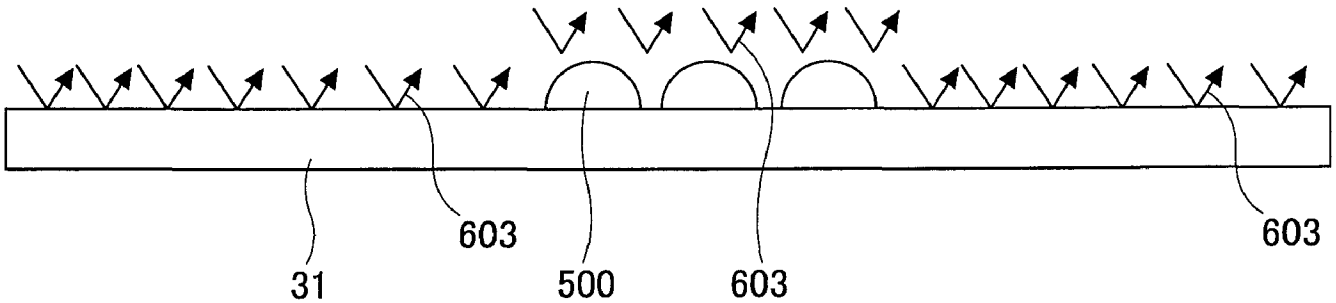

With reference to FIGS. 12A and 12B, still another case is considered in which the luster of the transport belt surface is reduced so that specular reflection is not readily produced upon being irradiated with the light from the light-emitting element 401, but rather diffused reflection is readily produced.

In this case, if the adjusting pattern 400 consisting of the independent droplets 500 is formed as shown in FIG. 12B, the specular reflection 603 from the adjusting pattern 400 is reduced as mentioned above so much that it cannot be distinguished from the specular reflection from the transport belt 31 surface. As a result, the sensor output voltage So becomes roughly the same as the output value from the transport belt 31 surface, making it difficult to detect the position of the adjusting pattern 400.

Thus, the surface condition of the transport belt 31 at the pattern-formed position is determined by scanning the surface with the reading sensor 401. Based on the sensor output, it is determined whether the surface condition at the pattern-formed position indicates a specular reflection region producing a greater amount of specular reflection than diffused reflection, or a diffused reflection region producing a greater amount of diffused reflection than specular reflection.

If the surface condition indicates the specular reflection region, a first pattern is formed as the adjusting pattern 400 from which the amount of specular reflection produced is smaller than the diffused reflection. If the surface condition indicates the diffused reflection region, a second pattern is selected as the adjusting pattern 400 so that the amount of specular reflection is greater than the diffused reflection. Thus, the adjusting pattern 400 can be accurately detected regardless of the surface condition of the transport belt 31.

Figure 14:
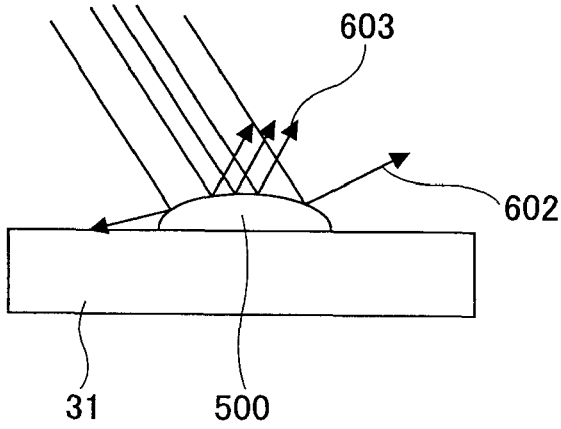
FIG. 14 illustrates how light is diffused by a droplet that is flattened.
Figure 15:
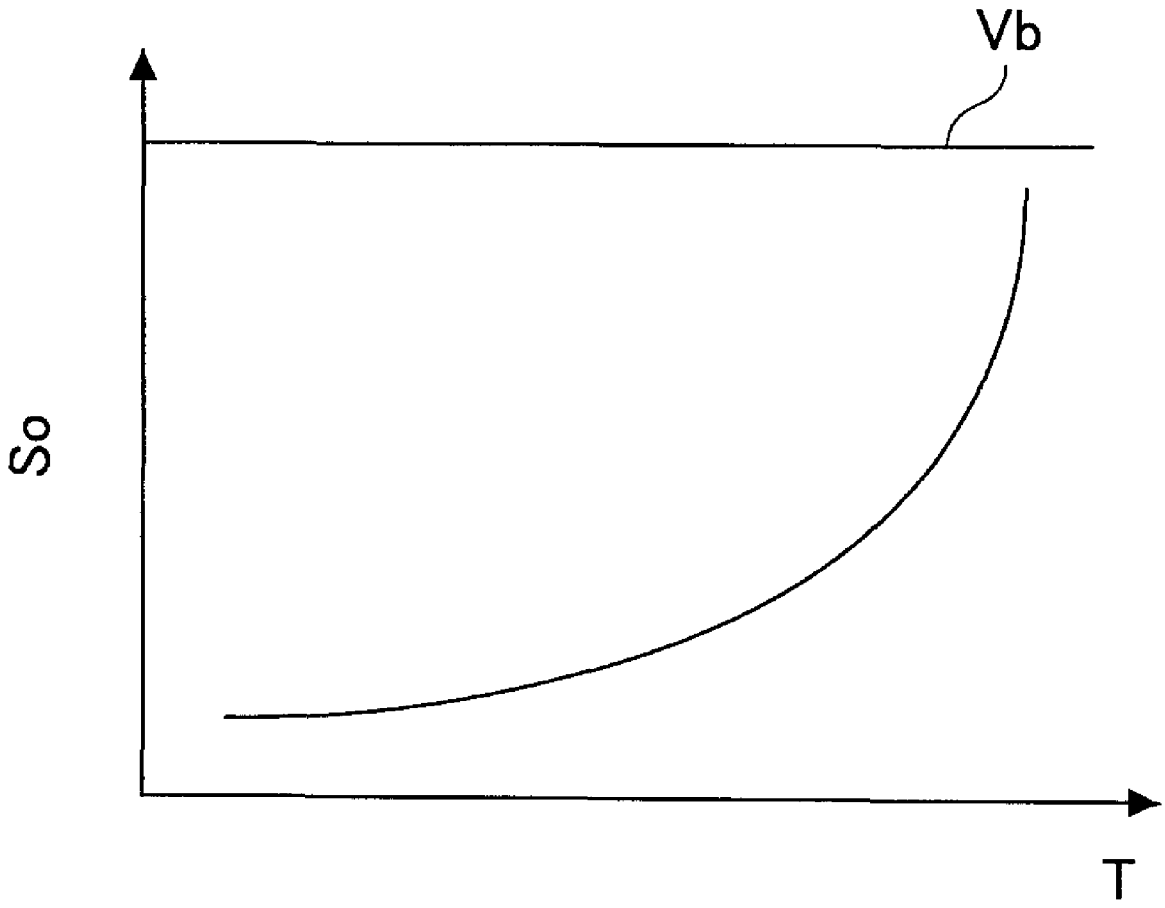
FIG. 15 shows how a sensor output voltage varies over time.

With reference to FIG. 14, the independent ink droplet 500 dries over time and loses luster from its surface, and its shape gradually flattens. As a result, the area from which the specular reflection 603 is produced increases relative to the diffused reflection 602, so that eventually the specular reflection 603 cannot be distinguished from the reflected light from the transport belt 31 surface. When the first adjusting pattern is formed, the sensor output voltage So approaches, over time T, the output voltage when the reflected light is received from the transport belt 31 surface, as shown in FIG. 15, resulting in decreasing detection accuracy over time. Thus, it is preferable to detect the adjusting pattern 400 before the ink droplets 500 become flat.

When the pattern is detected by analyzing portions of the output of the light-receiving unit that receives the specular reflection from the ink droplets, in which the specular reflection is reduced, the first adjusting pattern 400 is preferably made of independent plural droplets within the detection region of the reading sensor 401. Preferably, these ink droplets are densely provided; i.e., the areas between the individual droplets are preferably small compared with the areas in which the droplets are attached within the detection region.

Thus, based on the unique properties of the droplets, by forming a pattern of independent plural droplets on the water-repellent transport belt, the pattern can be accurately detected based on the change in the amount of specular reflection from the pattern. Thus, a gap deviation can be accurately detected.

In the following, various examples of the process of detecting the position of the adjusting pattern 400 formed on the transport belt 31, and the process of calculating the distance between the patterns 400*a* and 400*b* are described with reference to FIGS. 16 through 18.

Figure 16A:
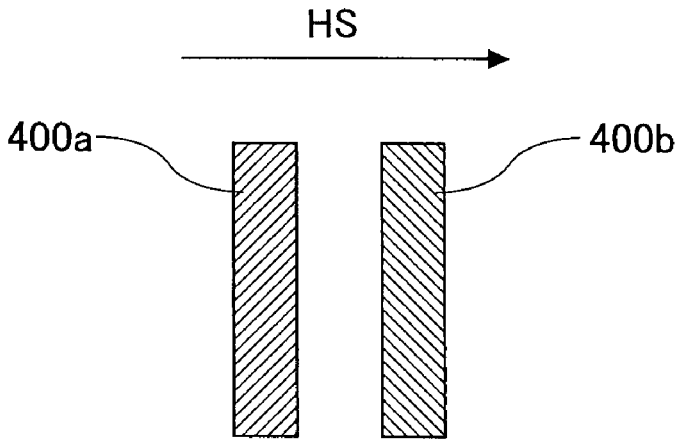
FIGS. 16A and 16B illustrate a first example of how the positions of adjusting patterns formed on the transport belt and their distance are determined.
Figure 16B:
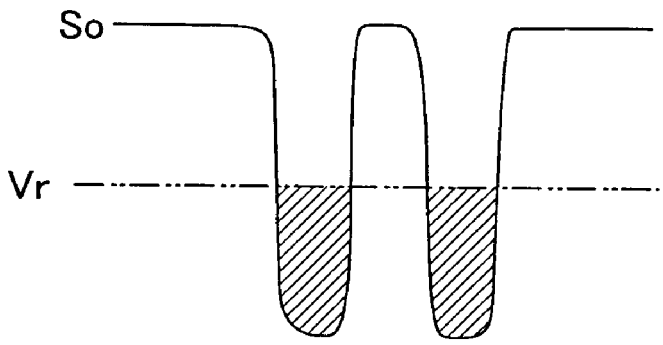

A first example is described with reference to FIGS. 16A and 16B. In the first example, the reference pattern 400*a* and the measured pattern 400*b* are formed on the transport belt 31 as shown in FIG. 16A. The patterns 400*a* and 400*b* are scanned by the reading sensor 401 in the sensor scan direction (horizontal scan direction; HS). The light-receiving element 403 of the reading sensor 401 produces a sensor output voltage So as shown in FIG. 16B, in which the voltage falls in a manner corresponding to the reference pattern 400*a* and the measured pattern 400*b*.

The sensor output voltage So is then compared with a predetermined threshold value Vr, and the positions at which the sensor output voltage So crosses the threshold value Vr can be detected as the edges of the reference pattern 400*a* and the measured pattern 400*b*. An areal center of gravity of each of the regions enclosed by the threshold value Vr and the sensor output voltage So (the hatched areas) is calculated. The thus calculated areal center of gravity can be considered the center of each of the patterns 400*a* and 400*b*. By thus using the concept of center of gravity, errors due to minute fluctuations in the sensor output voltage can be reduced.

Figure 17A:
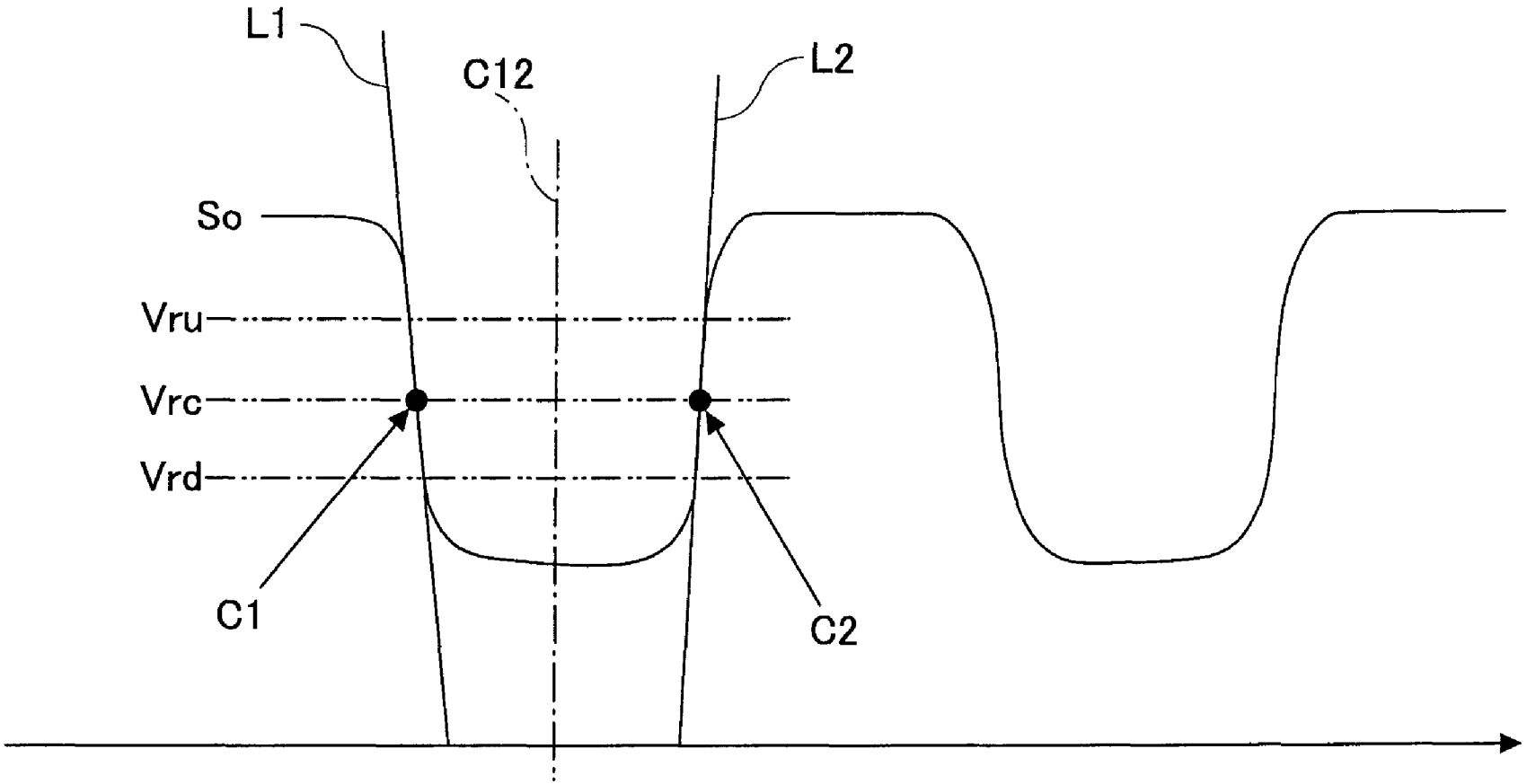
FIGS. 17A and 17B illustrate a second example of how the positions of adjusting patterns formed on the transport belt and their distance are determined.
Figure 17B:
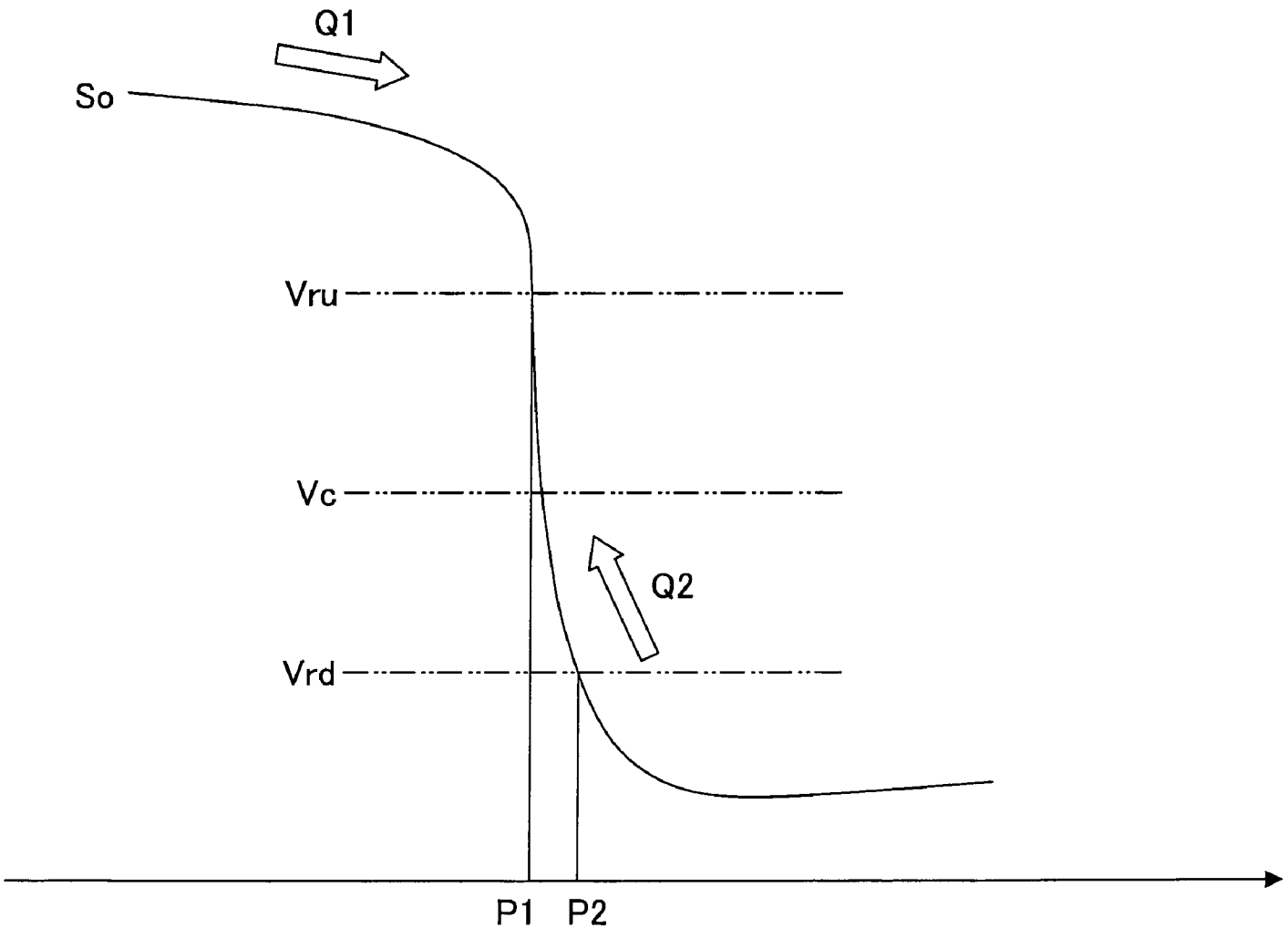

FIGS. 17A and 17B show the second example. In the second example, the reference pattern 400*a* and the measured pattern 400*b* similar to those of the first example are scanned by the reading sensor 401, obtaining a sensor output voltage So shown in FIG. 17A. FIG. 17B shows an enlarged view of a fall portion of the sensor output voltage So.

In the fall portion, the sensor output voltage So is tracked in a direction Q1 shown in FIG. 17B to a point P2 where the sensor output voltage So crosses (i.e., drops below) a lower-limit threshold value Vrd, which is then stored in memory. Then, the sensor output voltage So is tracked from the point P2 in a direction Q2 to find a point P1 where the sensor output voltage So exceeds an upper-limit threshold value Vru, and P1 is also stored.

Based on the output voltage So between the points P1 and P2, a regression line L1 is calculated, and a point of intersection between the regression line L1 and an intermediate value Vrc of the upper and lower threshold values is calculated as an intersecting point C1, as shown in FIG. 17A.

Similarly, a regression line L2 is calculated in a rise portion of the sensor output voltage So, and an intersecting point between the regression line L2 and an intermediate value Vrc between the upper and lower threshold values is calculated as the intersecting point C2. Then, a line center C12 is calculated by dividing the distance between the intersecting points C1 and C2 in half.

Figure 18A:
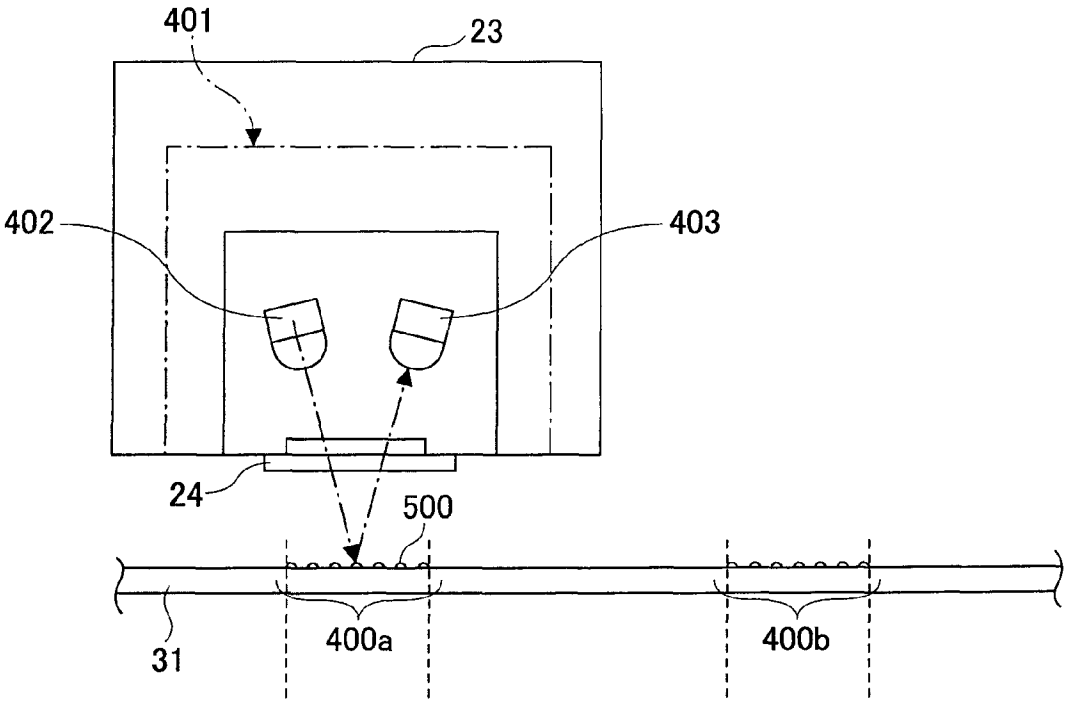
FIGS. 18A and 18B illustrate a third example of how the positions of adjusting patterns formed on the transport belt and their distance are determined.
Figure 18B:
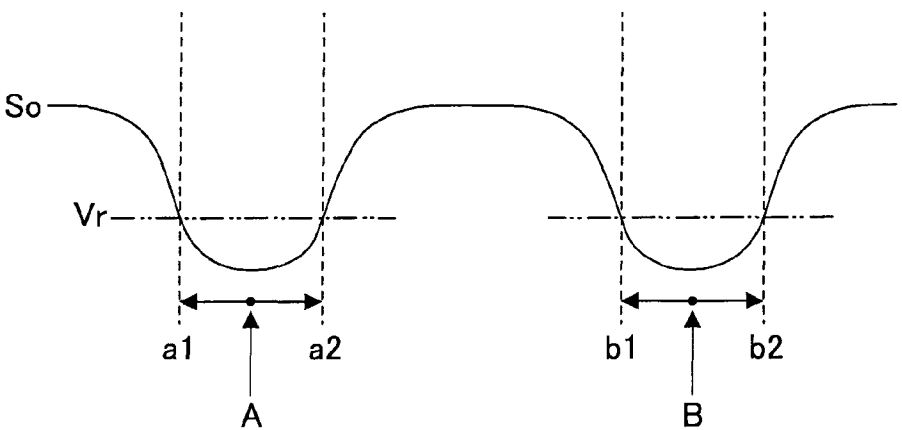

FIGS. 18A and 18B show the third example. In the third example, as shown in FIG. 18A, the reference pattern 400*a* and the measured pattern 400*b* are formed on the transport belt 31 as in the first example. These patterns are scanned by the reading sensor 401 in the horizontal scan direction, obtaining a sensor output voltage (photoelectric-converted output voltage) So shown in FIG. 18B.

Then, an IIR filter may be used to remove harmonic noise, followed by an evaluation of the quality of the detection signal (to find any deficiency, instability, or excess). An inclined portion of the sensor output voltage So near the threshold value Vr is detected to calculate a regression curve. Thereafter, intersecting points a1, a2, b1, and b2 between the regression curve and the threshold value Vr are calculated (by using a position counter in practice, for example). Then, an intermediate point A between the intersecting points a1 and a2, and an intermediate point B between the intersecting points b1 and b2 are calculated.

In the following, the adjusting pattern 400 is described with reference to FIG. 19.

The minimum unit of the adjusting pattern 400 for landing position error detection includes reference patterns 400*a*1 and 400*a*2 with a measured pattern 400*b* disposed between them without any overlap along the carriage scan direction.

The distance between the two reference patterns 400*a*1 and 400*a*2, and the distance between one of the reference patterns 400*a*1 and 400*a*2 and the measured pattern 400*b*, are calculated by multiplying the time differences between the patterns 400*a*1, 400*a*2, and 400*b* detected by the reading sensor 401 mounted on the carriage 23, with a predetermined carriage moving speed.

The calculated values are then adjusted by incorporating a carriage moving speed variation correction ratio calculated from the distance between the reference patterns 400*a*1 and 400*a*2, thereby correcting the position error amount of the measured pattern 400*b* from the reference pattern 400*a*. Based on the thus corrected position error amount, the drop discharge timing is controlled.

Figure 19:
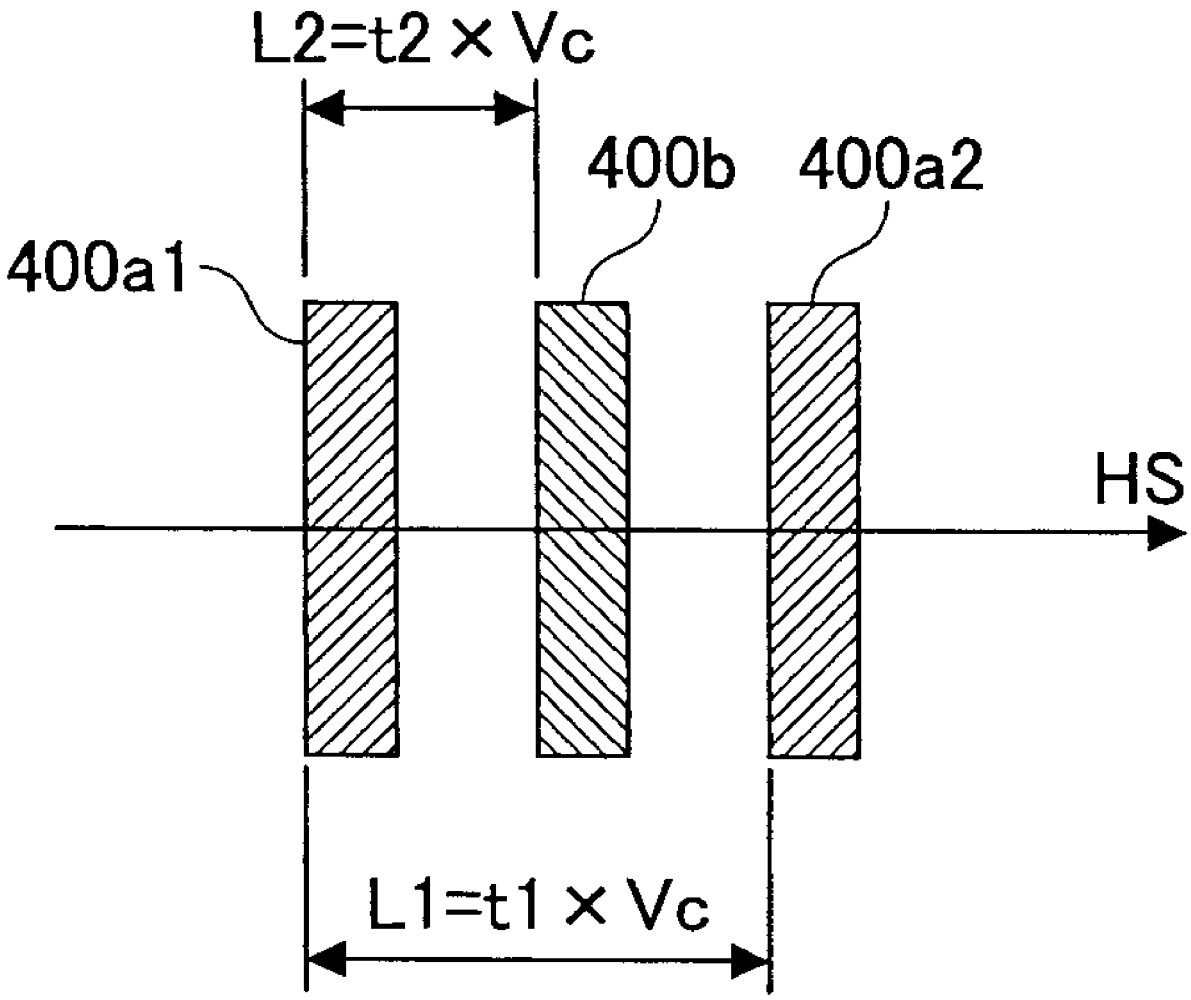
FIG. 19 shows a basic unit of adjusting patterns.

The above is described more specifically with reference to FIG. 19. When the carriage 23 is moved in the sensor scan direction (HS) and the pattern 400 is read by the reading sensor 401, the time between the detection of the reference pattern 400*a*1 and the detection of the measured pattern 400*b* is t2. The time between the detection of the reference pattern 400*a*1 and the detection of the next reference pattern 400*a*2 is t1. When the moving speed of the carriage 23 is Vc, the distance (read value) L1 between the reference patterns 400*a*1 and 400*a*2 is calculated by L1=t1×Vc. The distance (read value) L2 between the reference pattern 400*a*1 and the measured pattern 400*b* is calculated by L2=t2×Vc.

Since a theoretical distance La2 between the reference pattern 400*a*1 and the measured pattern 400*b* is determined in advance, the position error amount of the measured pattern 400*b* with respect to the reference pattern 400*a*1 can be calculated by (La2−L2).

When a theoretical distance between the reference patterns 400*a*1 and 400*a*2 is La1, the read value L1 would be equal to the theoretical value La1 in the absence of any velocity variation in the carriage velocity Vc upon reading. If a velocity variation is present during reading so that the moving speed of the carriage 23 is shifted from the predetermined velocity Vc, the read value L1 differs from the theoretical value La1.

Thus, based on the theoretical distance value La1 and the read distance value L1 between the reference patterns, a velocity variation correction ratio is calculated by dividing the theoretical distance value La1 by the read distance value L1. The position error amount of the measured pattern 400*b* with respect to the reference pattern 400*a*1 is then multiplied by this velocity variation correction ratio. In this way, a correct position error amount of the measured pattern 400*b* can be obtained.

Figures 20A, 20B:
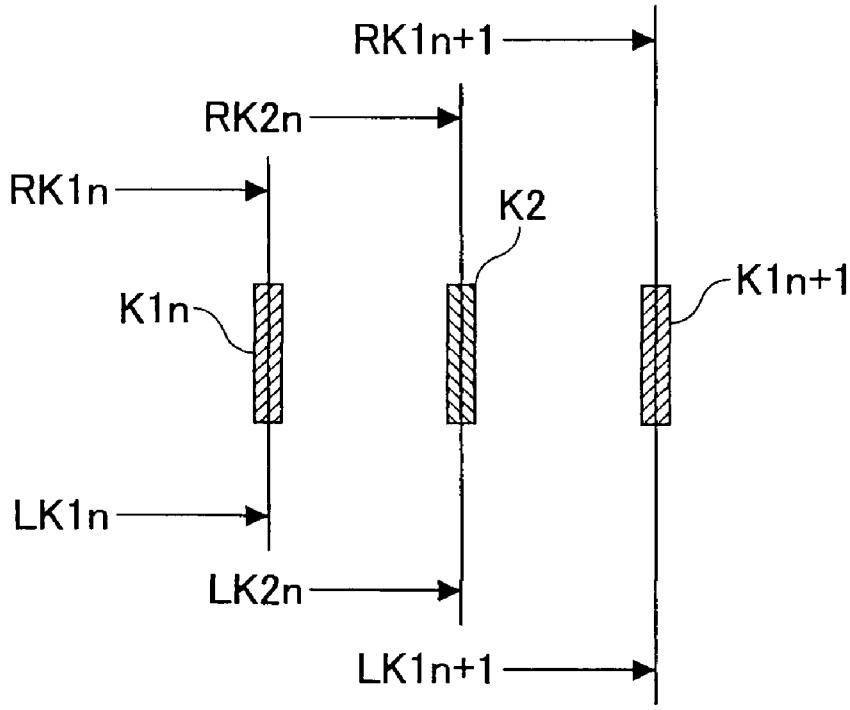
FIGS. 20A and 20B show how to calculate a position error amount in which a carriage velocity variation correction ratio is considered.

FIG. 20B shows an expression for calculating the position error amount of the measured pattern in which the aforementioned moving speed variation correction ratio of the carriage 23 is incorporated. FIG. 20A shows reference patterns K1*n* and K1*n*+1, and a measured pattern K2, with the theoretical values (positions) of RK1*n*, RK1*n*+1, and RK2*n*, and the sensor detected values (positions) of LK1*n*, LK1*n*+1, and LK2*n*, respectively.

As shown in FIG. 20B, the calculation $\{(RK2n-RK1n)-(LK2n-LK1n)\}\times(RK1n+1-RK1n)/(LK1n+1-LK1n)$ is performed, whereby the position error amount of the measured pattern from the reference (patterns) is corrected by the velocity variation correction ratio.

In the following, different examples of the adjusting pattern 400 are described with reference to FIGS. 21 through 23.

Figure 21:
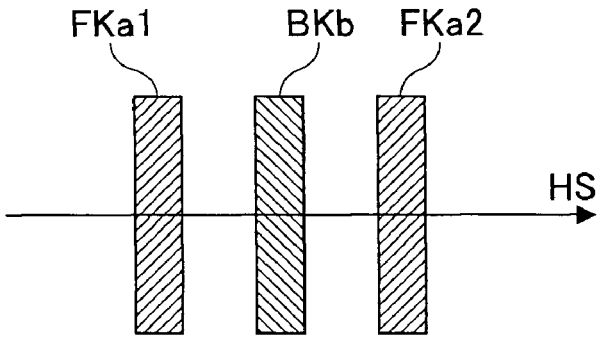
FIG. 21 shows a ruled line error adjusting pattern.

FIG. 21 shows adjusting patterns for adjusting a ruled line error of a single black-color recording head. Reference patterns FKa1 and FKa2 are formed by an outward-path scan, while a measured pattern BKb is formed between the reference patterns FKa1 and FKa2 by a homeward path scan.

Figure 22:
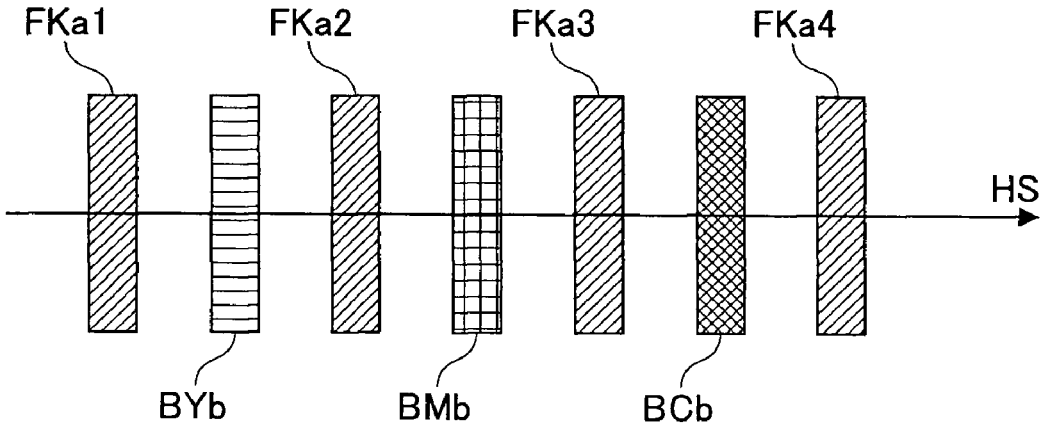
FIG. 22 shows a color error adjusting pattern.

FIG. 22 shows an example of adjusting patterns for color error adjustment. Four black reference patterns FKa1, FKa2, FKa3, and FKa4 are formed by an outward-path scan. Between these reference patterns, a cyan measured pattern BCb, a magenta measured pattern BMb, and a yellow measured pattern BYb are formed by a homeward path scan. While the reference patterns are black in the present example, the color of the reference patterns may be any of the CMYK colors.

Figure 23:
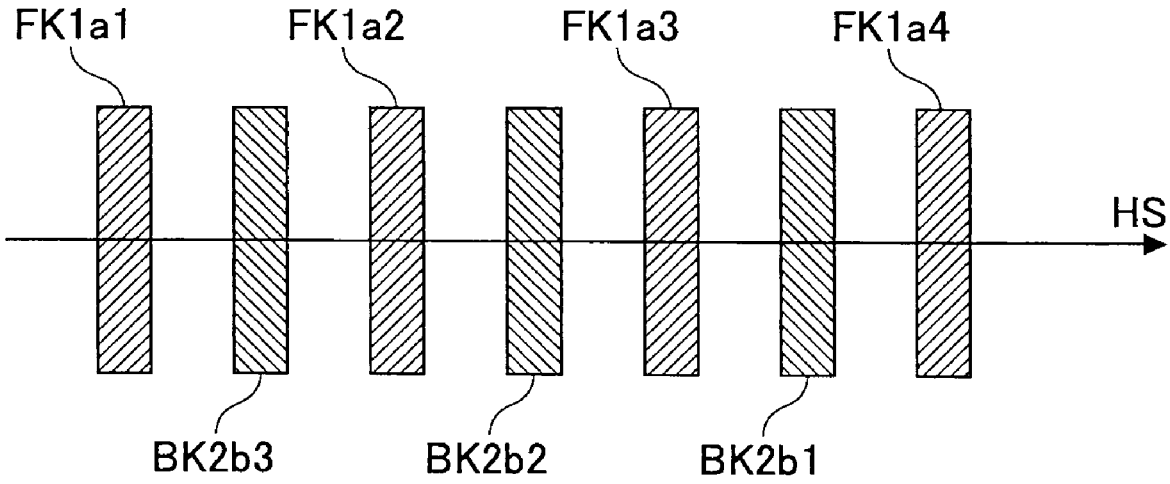
FIG. 23 shows a ruled line error adjusting pattern for a two-head configuration.

FIG. 23 shows an example of adjusting patterns for ruled line error adjustment between heads in a case where a two-head configuration is employed for the same color of black. Four reference patterns FK1*a*1, FK1*a*2, FK1*a*3, and FK1*a*4 are formed by an outward-path scan using a recording head 24*k*1. A measured pattern FK2*b*1 is formed between the reference patterns FK1*a*3 and FK1*a*4 also by the outward-path scan using a recording head 24*k*2. A measured pattern BK2*b*2 is formed between the reference patterns FK1*a*3 and FK1*a*2 by a homeward path scan using the recording head 24*k*2. A measured pattern BK2*b*3 is formed between the reference patterns FK1*a*2 and FK1*a*1 also by the homeward path scan using the recording head 24*k*2.

Figure 24:
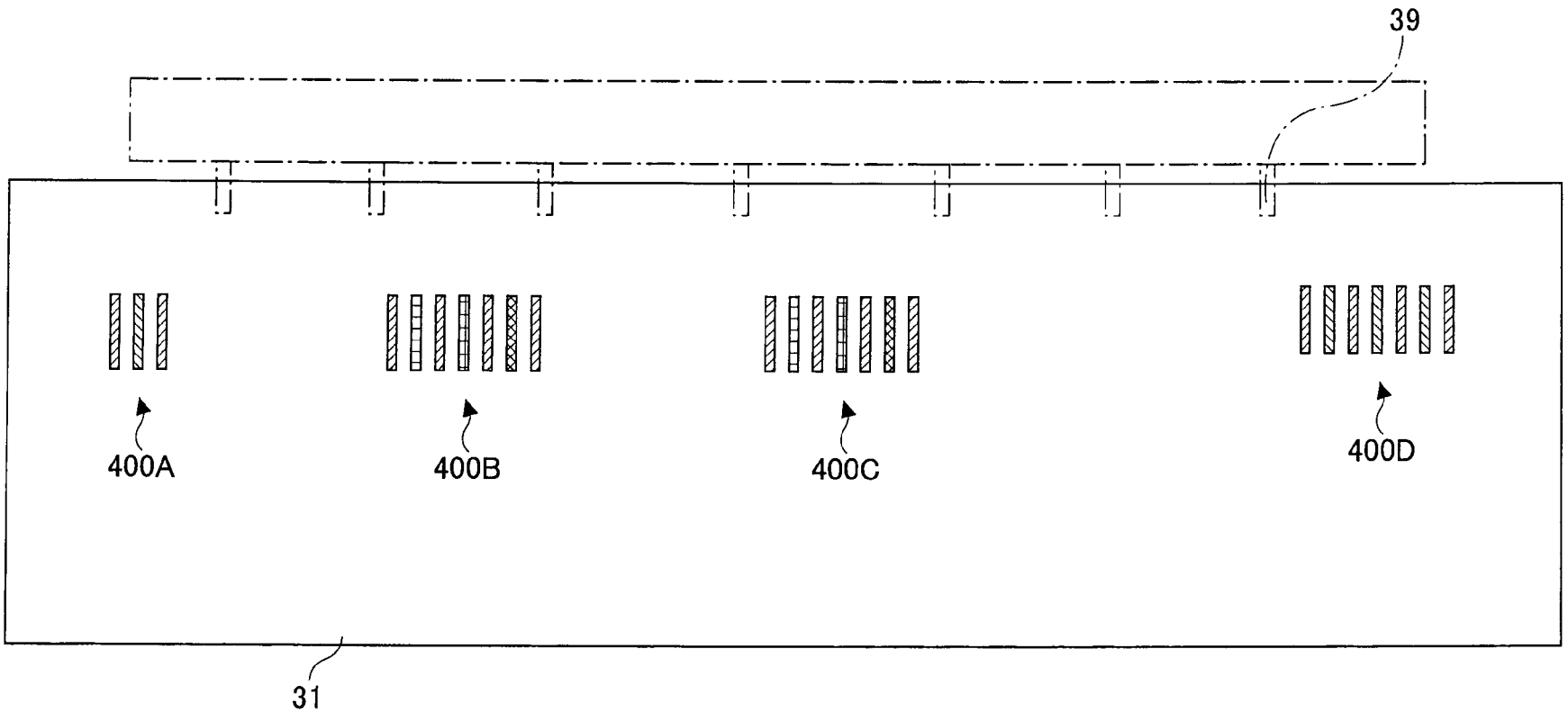
FIG. 24 shows a complex adjusting pattern.

When a plurality of blocks of the ruled line error adjusting patterns and the color error adjusting patterns are formed on the carriage scan line, a comprehensive adjusting pattern for adjusting the ruled line error and/or the color error can be formed, as shown in FIG. 24. In FIG. 24, an adjusting pattern 400A is a ruled line error adjusting pattern for the same head; adjusting patterns 400B and 400C are color error adjusting patterns; and a pattern 400D is a ruled line error adjusting pattern for different heads.

Thus, the adjusting pattern may be for both the ruled line error and the color error, as shown in FIG. 24, or it may consist of either the ruled line error adjusting pattern or the color error adjusting pattern alone, depending on the particular purpose. Thus, the plural reference patterns and measured patterns are arranged alternately at substantially uniform intervals, as opposed to a conventional test pattern.

Figure 25:
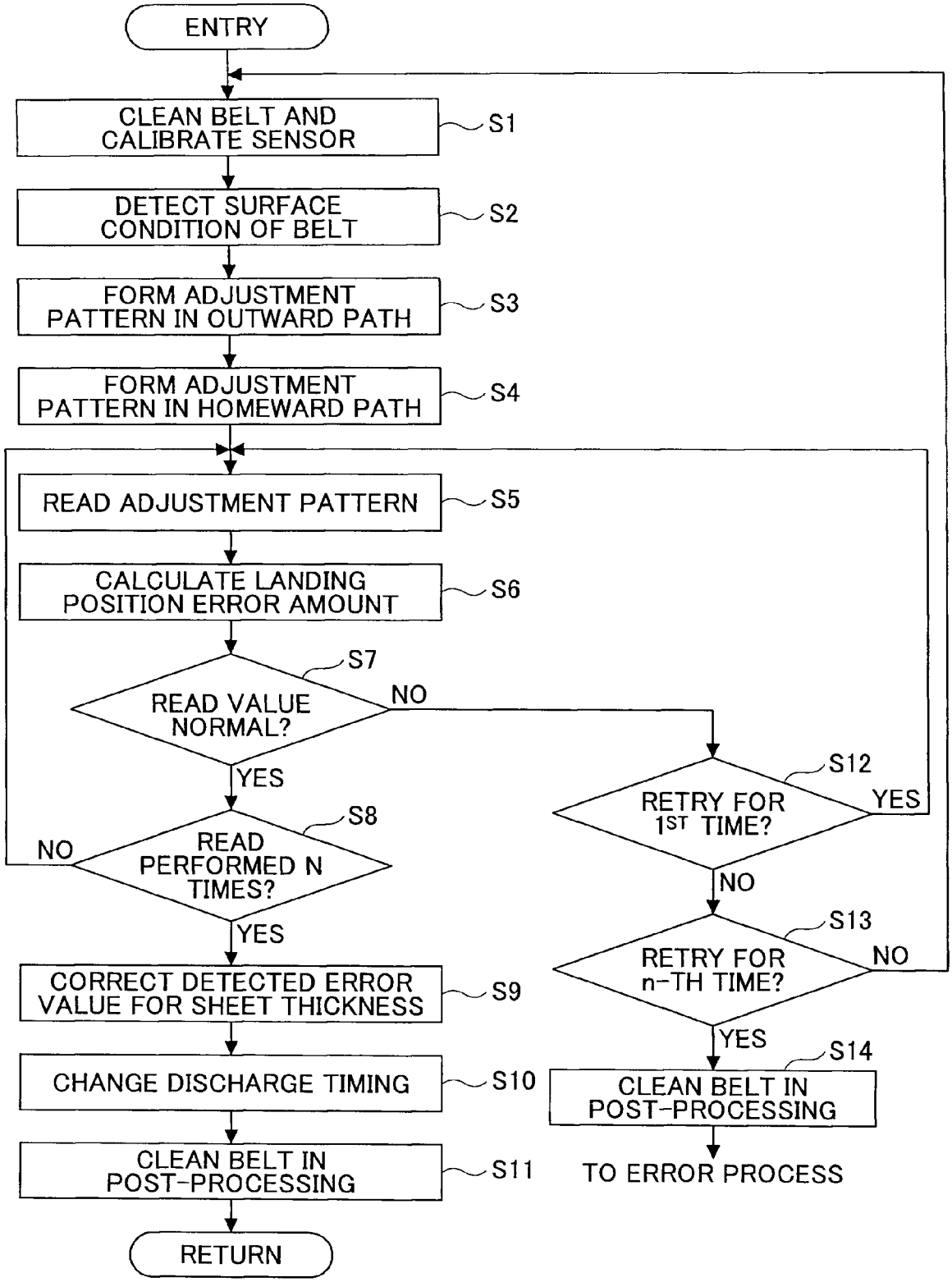
FIG. 25 shows a flow diagram of a droplet landing position error correction process.

Hereafter, a description is given of a droplet landing position error adjustment (correction) process with reference to FIG. 25, which is performed by the main control unit 310.

Upon entry into this process, the transport belt 31 is cleaned and the reading sensor 401 is calibrated (S1). Also, the output of the light-emitting element 402 is adjusted so that the output level of specular reflection of the reading sensor 401 (including the light-emitting element 402 and the light-receiving element 403) exhibits a certain value as the transport belt 31 surface is scanned by the reading sensor 401 that is moved with the carriage 23.

Thereafter, the belt surface condition at a pattern-formed position is detected based on the sensor output of the reading sensor 401 when the carriage 23 is moved in the horizontal scan direction (S2). Specifically, it is determined whether the belt surface condition at the pattern-formed position indicates the specular reflection region where the amount of specular reflection is greater than that of diffused reflection, or the diffused reflection region where the amount of diffused reflection is greater than that of specular reflection.

The carriage 23 is then moved in the horizontal scan direction for an outward-path scan while each of the recording heads 24 discharges ink droplets, thereby forming some of the adjusting patterns 400 that should be formed in the outward path (S3). This is followed by a homeward path scan in which each of the recording heads 24 discharges ink droplets to form the patterns that should be formed in the homeward path (S4).

When the detected surface condition of the transport belt 31 indicates the specular reflection region, the first adjusting pattern 400 is formed so that the amount of specular reflection is smaller than that of diffused reflection. On the other hand, when the surface condition indicates the diffused reflection region, the second adjusting pattern is selected so that the amount of specular reflection is greater than that of diffused reflection.

Thereafter, the carriage 23 is moved in the horizontal scan direction for an outward-path scan while the light-emitting element 402 of the reading sensor 401 emits light, and the adjusting pattern 400 is read (S5). As mentioned above, the distances between the patterns may be calculated based on the time and the carriage velocity. The position error amount based on the distances between the reference patterns 400*a* and the measured pattern 400*b* is corrected by the carriage velocity variation ratio based on the distance between the reference patterns 400*a*, thereby calculating a droplet landing position error amount (S6).

It is determined whether the read value obtained by the reading sensor 401 is normal (S7). If normal ("Y"), it is determined whether the reading has been performed N times (S8). If the read has not been performed N times ("N"), the routine returns to the reading process. Thus, the read is repeated N times in the outward path direction. When the read is performed N times ("Y" in S8), a print discharge timing correction value is calculated from an error amount (outward/homeward error amount) between the outward path and the homeward path of the carriage 23 that is corrected for the thickness of the sheet (S9). The print discharge timing is then corrected by the corrected value of the calculated droplet discharge timing (S10). Thereafter, the surface of the transport belt 31 is cleaned in a post-process (S11).

If the read value by the reading sensor 401 is not normal ("N" in S7), it is determined whether a retry is for the first time (S12). If the retry is for the first time ("Y"), the adjusting pattern 400 is read again. If not ("N"), it is determined whether the retry is for an n-th time (S13). If the retry is not for the n-th time ("N"), the routine returns to the process of forming the adjusting pattern 400. If the retry has been performed for the n-th time ("Y" in S13), the surface of the transport belt 31 is cleaned in a post-process (S14), and the routine continues to an error process.

Thus, on the water-repellent transport belt as a pattern forming member, there is formed a minimum unit of block patterns for detecting the landing position error, which includes a reference pattern and a measured pattern. The adjusting pattern is irradiated with light, and the specular reflection is received from the adjusting pattern to read the adjusting pattern.

Based on the adjusting pattern that is read, the landing position error amount is determined, and the landing position of the droplets discharged out of the recording head is corrected. In this way, the landing position of the droplets can be detected with high accuracy by a simple arrangement, and the droplet landing position error can be corrected highly accurately.

Figure 26A:
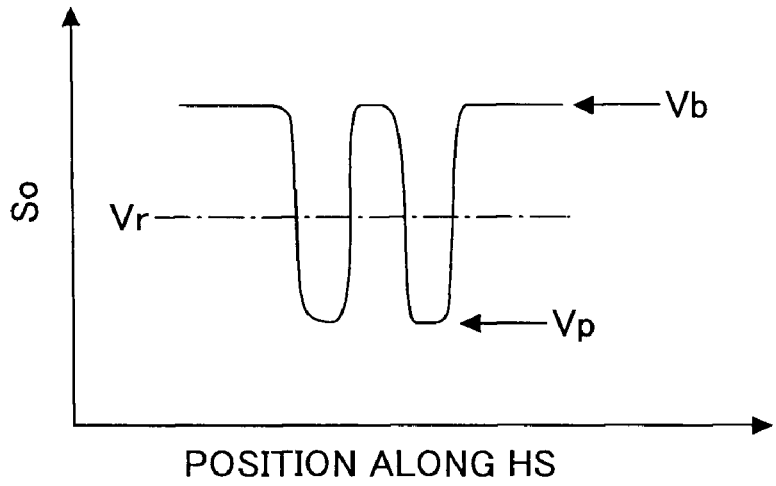
FIGS. 26A and 26B show an example of the formation of an adjusting pattern depending on the surface condition of the transport belt.
Figure 26B:
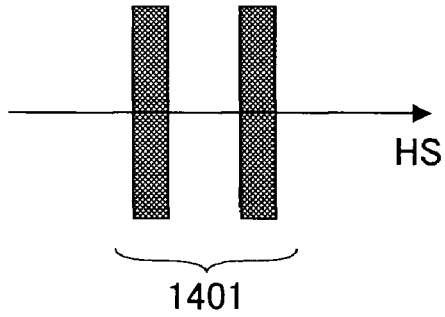
Figure 27A:
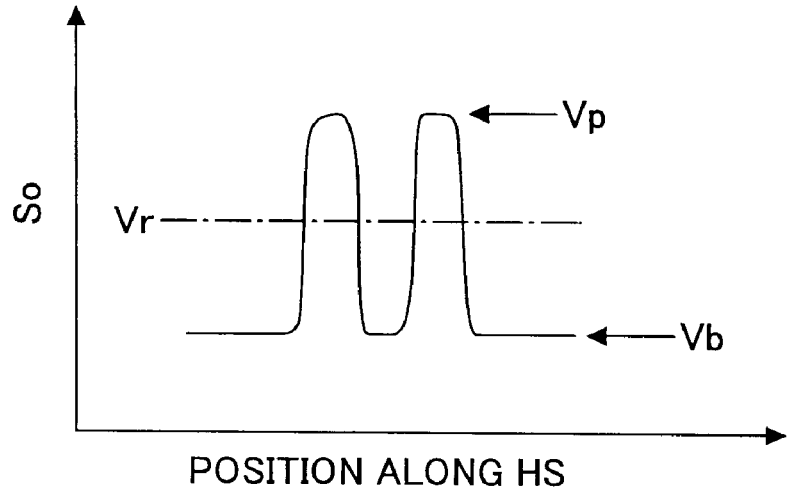
FIGS. 27A and 27B show another example of the formation of an adjusting pattern depending on the surface condition of the transport belt.
Figure 27B:
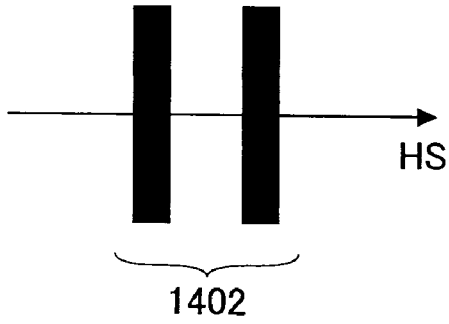
Figure 28A:
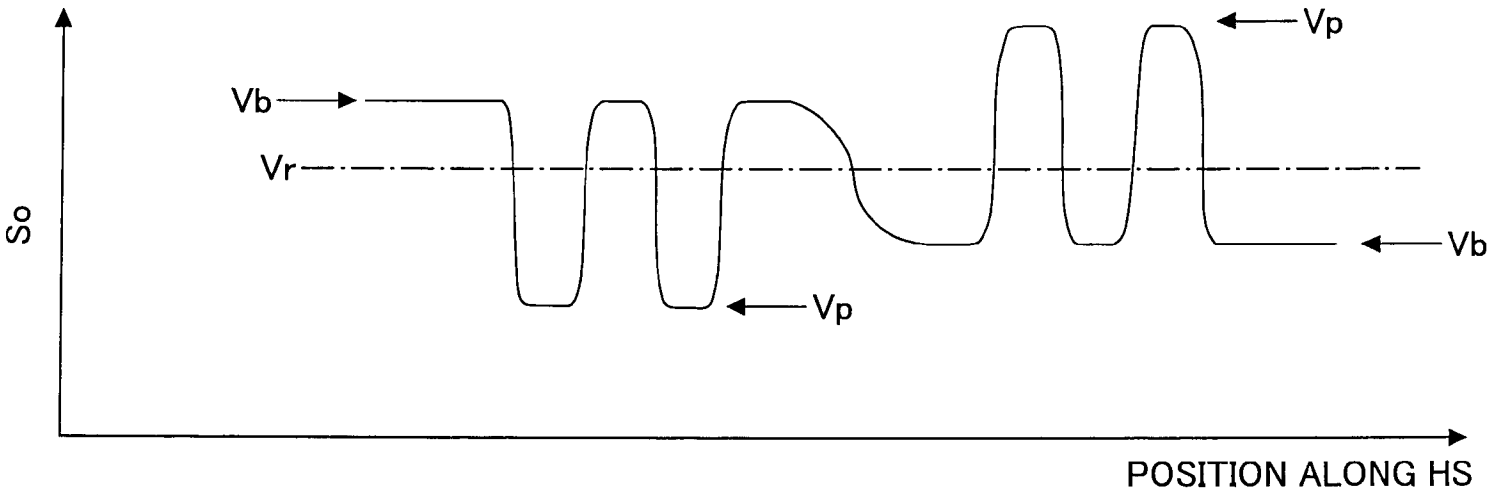
FIGS. 28A and 28B show an example of the formation of different adjusting patterns depending on the surface condition of the transport belt.
Figure 28B:
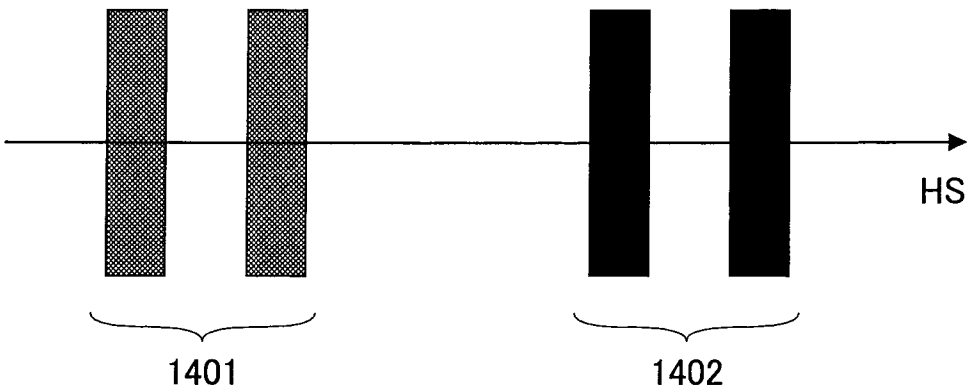

Hereafter, a description is given of the formation of the adjusting pattern depending on the surface condition of the transport belt 31 with reference to FIGS. 26 through 28.

When the surface of the transport belt 31 is lustrous, the specular reflection amount from the belt surface is large, as shown in FIG. 26. Thus, the first adjusting patterns 1401 are formed of independent droplets as the adjusting pattern 400, so that the amount of specular reflection from the pattern 400 is smaller than that of diffused reflection. Thus, the specular reflection amount is reduced at the adjusting pattern-formed position, thereby allowing the detection of the position of the adjusting pattern 400 along the horizontal scan direction HS.

On the other hand, when the surface of the transport belt 31 is coarse and not lustrous due to degradation over time, for example, the specular reflection amount from the belt surface (Vb) is small, as shown in FIG. 27. Thus, the second adjusting patterns 1402, which are formed of non-independent (such as merged) drops, are used as the adjusting pattern 400, so that the amount of specular reflection from the pattern 400 (Vp) is greater than that of diffused reflection. Thus, the specular reflection amount Vp at the adjusting pattern-formed position increases, thereby allowing the position of the adjusting pattern 400 along the horizontal scan direction HS to be detected.

By thus changing the adjusting pattern depending on the belt surface reflected light amount, it becomes possible to maintain a high position error detection accuracy regardless of degradation of the transport belt surface over time.

In the above embodiment, the first adjusting pattern 1401 or the second adjusting pattern 1402 may be selected as follows. As shown in FIGS. 26 and 27, a reference threshold value (predetermined value) Vr is set at an intermediate level between a large surface specular reflection amount when the transport belt 31 is new and a small specular reflection amount after degradation over time. The transport belt surface is then pre-scanned by the reading sensor 401 with no adjusting pattern 400 printed on the belt surface. A sensor detected voltage So and the threshold value Vr are then compared to determine whether the first adjusting pattern 1401 or the second adjusting pattern 1402 should be formed.

When the adjusting pattern 400 is formed at plural locations, as in the previous example shown in FIG. 24, if the specular reflection amount on the belt surface differs from one pattern-formed position to another, the surface may be pre-scanned by the reading sensor 401 to determine whether the specular reflection region or the diffused reflection region can ensure a minimum pattern width in each of the pattern-formed positions, as shown in FIG. 28.

If the belt surface detection voltage Vb is greater than the threshold value Vr at a certain pattern-formed position, the position may be determined as being the specular reflection region, and the first adjusting pattern 1401 is formed. If the belt surface detection voltage Vb is smaller than the threshold value Vr at another position, the position may be determined as being the diffused reflection region and the second adjusting pattern 1402 can be formed.

Thus, the S/N ratio of the position error detection accuracy can be increased depending on the position even when the specular reflection amount of the transport belt 31 is in transition between large and small values.

Figure 29:
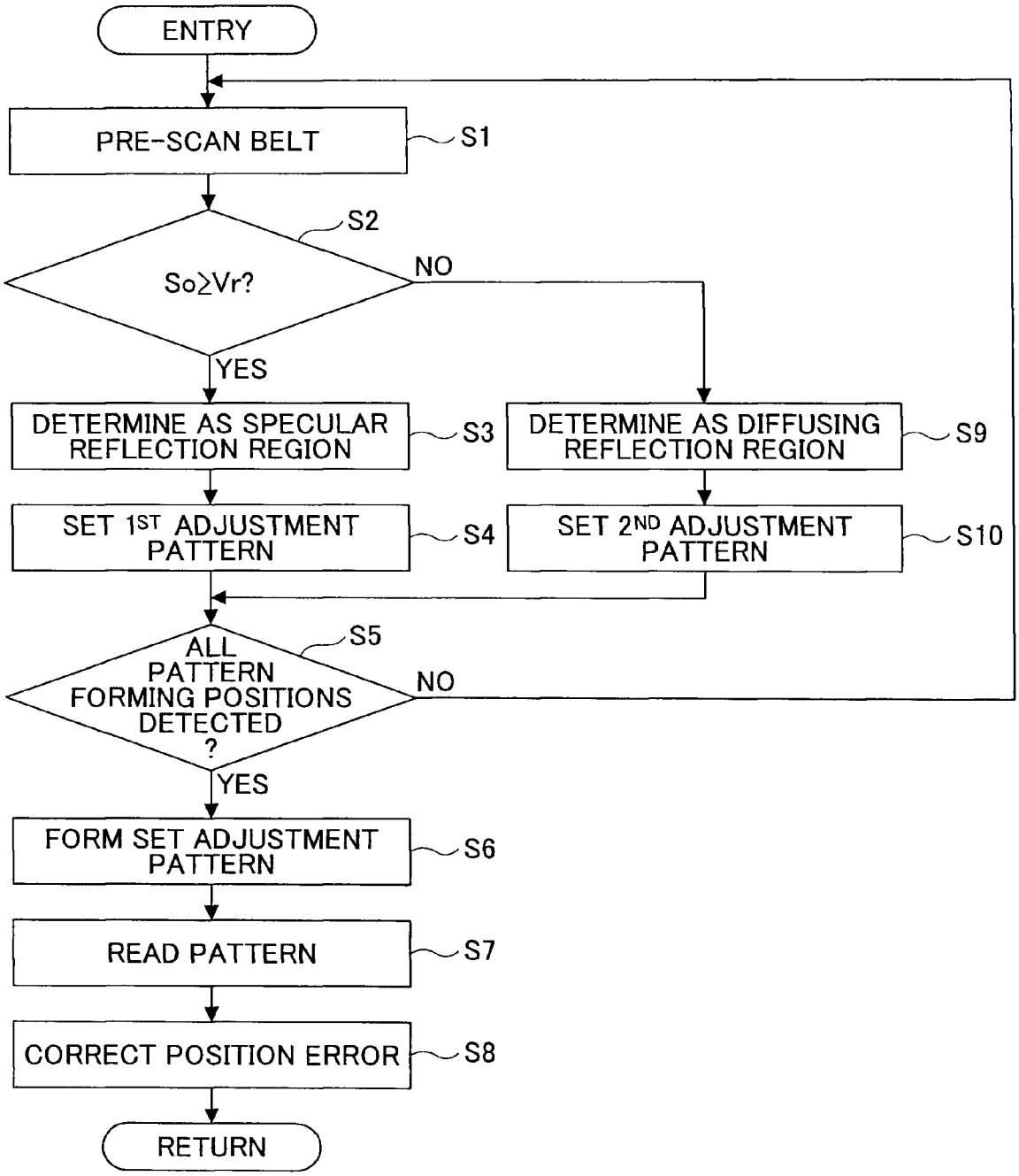
FIG. 29 shows a flow diagram of a landing position error adjusting process including a belt surface condition detection process.

Hereafter, a description is given of an example of a landing position error adjusting process including a belt surface condition detection process, with reference to FIG. 29.

As mentioned above, the pattern-formed position of the transport belt 31 is pre-scanned by the reading sensor 401 (S1), and the sensor output So and the predetermined threshold value Vr are compared (S2). If the sensor output So is greater than the threshold value Vr, it is determined that the position is the specular reflection region where the amount of specular reflection is greater than that of diffused reflection (S3), and the first adjusting pattern 1401 is set as the adjusting pattern 400 that is formed (S4).

On the other hand, if the sensor output So is smaller than the threshold value Vr, it is determined that the region is the diffused reflection region where the amount of specular reflection is smaller than that of diffused reflection (S9), and the second adjusting pattern 1402 is set as the adjusting pattern 400 that is formed (S10). The surface condition of each pattern-formed positions is detected (S5), and, as mentioned above, the adjusting pattern 400 that is set is formed (S6) and then read by the reading sensor 401 (S7). Depending on the result of reading, landing position error correction is performed by correcting the drop discharge timing, for example (S8).

Hereafter, a description is given of different examples of producing the first adjusting pattern 1401 and the second adjusting pattern 1402, with reference to FIGS. 30 and 31.

Figure 30B:
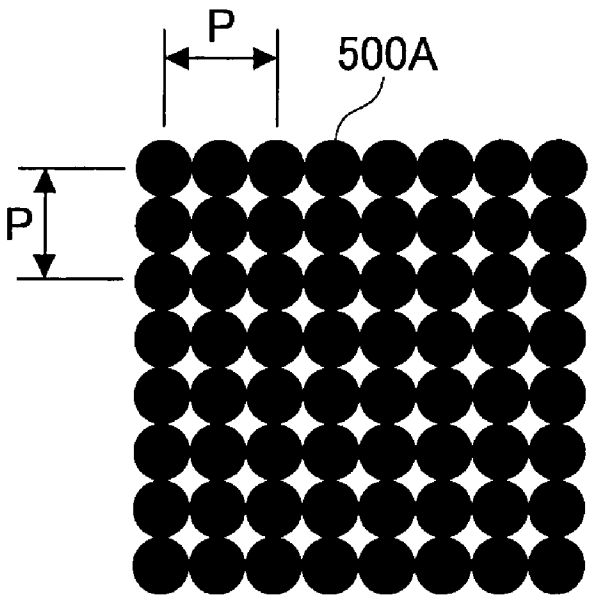
FIGS. 30A and 30B show a first pattern and a second pattern according to an embodiment.
Figure 30A:
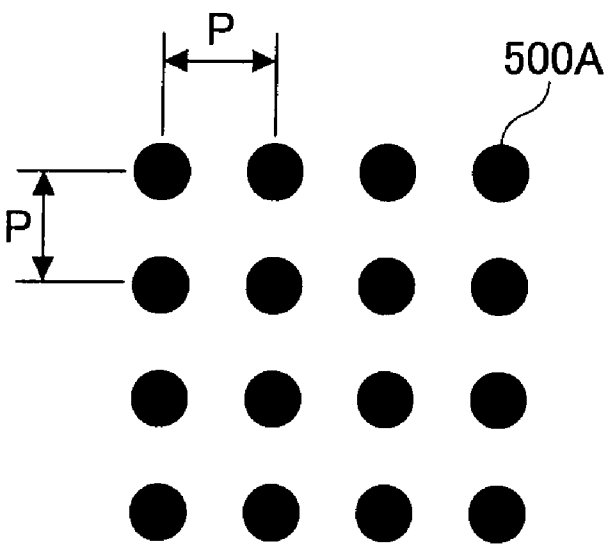

FIGS. 30A and 30B show a first example in which the amount of each droplet is the same between the first adjusting pattern 1401 and the second adjusting pattern 1402.

FIG. 30A shows the first adjusting pattern 1401 in which droplets 500A are independently arranged at predetermined intervals P (in both the horizontal scan direction and the vertical scan direction). FIG. 30B shows the second adjusting pattern 1402 in which droplets 500A of the same size are arranged closely at intervals of P/2.

By thus causing the droplets to land in different arrangements without changing the amount of each droplet (i.e., discharged amount of droplet), one of the factors of landing position error that is due to the size of the droplets discharged out of the recording head 24 can be eliminated. As a result, an higher position error detection accuracy can be maintained.

Figure 31B:
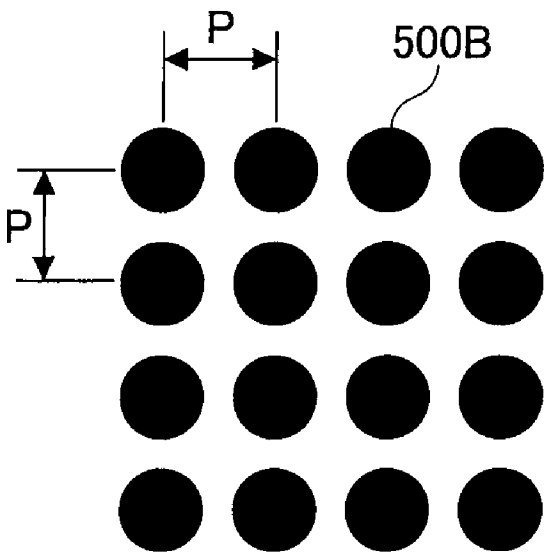
FIGS. 31A and 31B show a first pattern and a second pattern according to another embodiment.
Figure 31A:
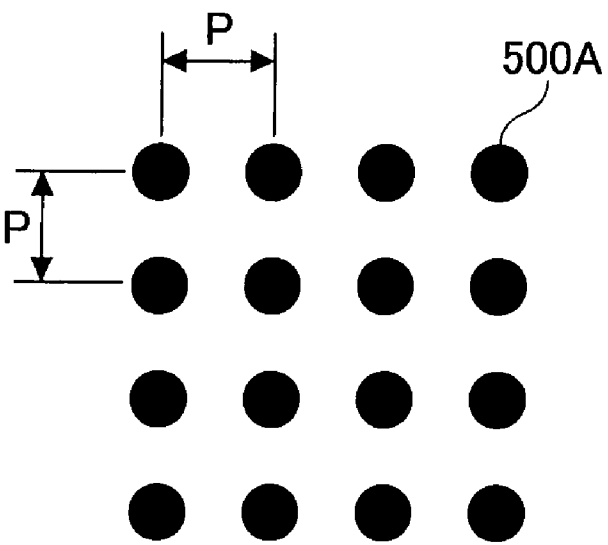

FIGS. 31A and 31B show a second example in which the size of droplet is changed but the arrangement of the droplets is the same between the first adjusting pattern 1401 and the second adjusting pattern 1402.

FIG. 31A shows the first adjusting pattern 1401 in which independent droplets 500A are arranged at predetermined intervals P (in both the horizontal scan direction and the vertical scan direction). FIG. 31B shows the second adjusting pattern 1402 in which droplets 500B that are larger (i.e., the amount of each droplet (=discharged droplet amount) is greater) than the droplets 500A are arranged at the same intervals P as the first adjusting pattern 1401.

By thus changing the droplet amount without changing the droplet arrangement, the total droplet discharge amount for forming the adjusting patterns can be reduced compared with the first example involving the change in droplet arrangement, so that the required amount of ink can be reduced.

Specifically, when the droplet amount is increased a little without changing the droplet arrangement as shown in FIG. 31B, each droplet 501 should remain independent without merging with the other droplets 501. In practice, however, as the weight of droplet increases, the force of inertia due to the carriage moving speed comes into play upon landing of the droplets.

Figure 32:
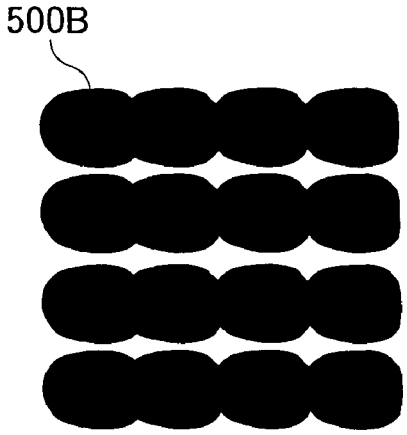
FIG. 32 shows an actual example of a second pattern.

As a result, as shown in FIG. 32, the droplets 500B flow over the water-repellent belt surface and merge in the horizontal scan direction. Thus, the total droplet discharge amount can be reduced. Another advantageous effect is that a belt cleaning mechanism, which may be provided for removing the ink attached on the belt, is put to less belt cleaning load.

Another embodiment of the present invention are described with reference to FIGS. 33 and 34.

In this embodiment, the first adjusting pattern or the second adjusting pattern is selected based on a predetermined threshold value that correlates with the surface condition of the transport belt 31, without detecting the surface condition of the transport belt 31 directly (by the pre-scan with an optical sensor).

Figure 33:
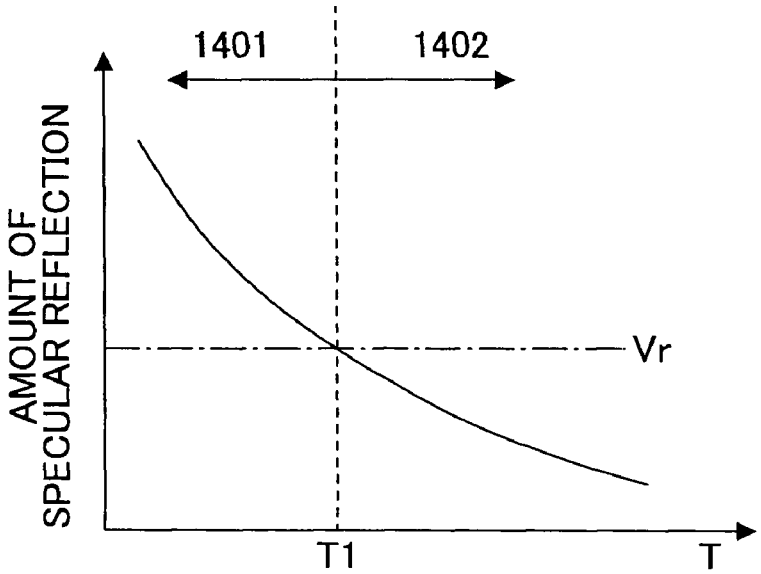
FIG. 33 shows how the amount of belt surface reflected light varies over time of use of the belt according to an embodiment.

As shown in FIG. 33, the specular reflection amount from the belt surface decreases over time as the image forming apparatus is used. Thus, a threshold value T1 of an elapsed time is set in advance at which the reversal of the S/N ratio of the detection accuracy of the first adjusting pattern and the second adjusting pattern is expected. Below the fixed threshold value T1, the first adjusting pattern 1401 is formed. Beyond the fixed threshold value T1, the second adjusting pattern 1402 is selected.

Figure 34:
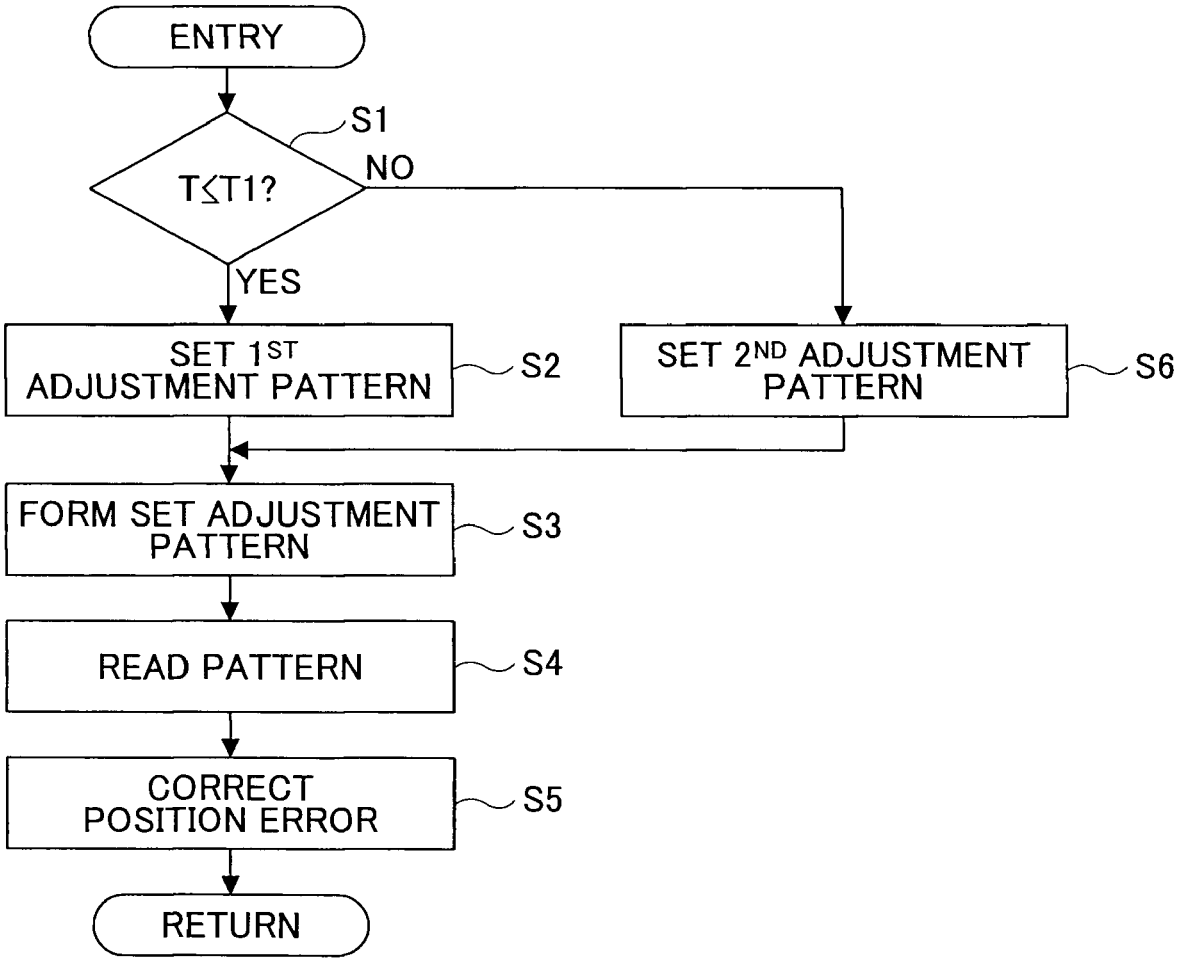
FIG. 34 shows a flow diagram of a landing position error adjusting process according to an embodiment.

The above process may have a sequence shown in FIG. 34. Following the start of the landing position error correction process, it is determined whether the apparatus use time T is equal to or less than a predetermined time (fixed threshold value) T1 in step S1. If the predetermined time T1 is not exceeded ("Y"), the first adjusting pattern is set (S2). If the predetermined time is exceeded ("N"), the second adjusting pattern is set (S6). The adjusting pattern 400 that has been set is formed (S3) and then read by the reading sensor 401 (S4). Depending on the result of reading, a landing position error correction is performed by correcting the drop discharge timing, for example (S5).

Thus, the pre-scan operation by the optical sensor (reading sensor 401) is not required, so that the position error adjusting time can be reduced.

The predetermined threshold value that correlates with the surface condition of the transport belt 31 may include the number of sheets that have been passed, the number of times of landing position error adjustment (i.e., the amount of ink that has been used for forming the adjusting pattern), or the amount of rotation of the belt, as well as the aforementioned use time of the apparatus.

Although this invention has been described in detail with reference to certain embodiments, variations and modifications exist within the scope and spirit of the invention as described and defined in the following claims.

The present application is based on the Japanese Priority Application No. 2008-008458 filed Jan. 17, 2008, the entire contents of which are hereby incorporated by reference.

What is claimed is:

1. An image forming apparatus comprising:

a carriage carrying a recording head configured to discharge a droplet;

a pattern forming unit configured to form a landing position error detecting pattern on a pattern forming member;

a reading unit mounted on the carriage and configured to read the landing position error detecting pattern formed on the pattern forming member, the reading unit including a light-emitting unit and a light-receiving unit;

a landing position error correction unit configured to correct a landing position error of the droplet discharged by the recording head based on a result of reading the landing position error detecting pattern by the reading unit; and a surface condition detection unit configured to detect a surface condition of a region of the pattern forming member where the landing position error detecting pattern is formed, using the pattern reading unit, wherein the pattern forming unit selects either a first pattern or a second pattern as the landing position error detecting pattern, depending on the surface condition of the pattern-formed region that is determined by the surface condition detection unit, wherein the first pattern produces a relatively small amount of specular reflection compared with diffused reflection, while the second pattern produces a relatively large amount of specular reflection compared with diffused reflection, upon irradiation with light emitted by the light-emitting unit.

2. The image forming apparatus according to claim 1, wherein the surface condition detection unit causes the reading unit to scan the pattern forming member to determine whether the pattern-formed region is a specular reflection region or a diffused reflection region, wherein the pattern-formed region is the specular reflection region when the amount of specular reflection received by the light-receiving unit from the pattern-formed region upon irradiation with the light emitted by the light-emitting unit exceeds a predetermined value, wherein the pattern-formed region is the diffused reflection region when the amount of specular reflection received by the light-receiving unit from the pattern-formed region upon irradiation with the light emitted by the light-emitting unit is below the predetermined value.

3. The image forming apparatus according to claim 2, wherein the pattern forming unit forms the first pattern or the second pattern depending on whether the specular reflection region or the diffused reflection region enables the formation of the landing position error detecting pattern with a minimum pattern width.

4. The image forming apparatus according to claim 2, wherein the first pattern or the second pattern is formed depending on whether the pattern-formed region is the specular reflection region or the diffused reflection region.

5. An image forming apparatus comprising:

a carriage carrying a recording head configured to discharge a droplet;

a pattern forming unit configured to form a landing position error detecting pattern on a pattern forming member;

a reading unit mounted on the carriage and configured to read the landing position error detecting pattern on the pattern forming member, the reading unit including a light-emitting unit and a light-receiving unit; and a landing position error correction unit configured to correct a landing position error of the droplet discharged by the recording head, based on a result of reading the landing position error detecting pattern by the reading unit, wherein the pattern forming unit selects either a first pattern or a second pattern as the landing position error detecting pattern depending on whether a predetermined value that correlates with a surface condition of the pattern forming member is exceeded, wherein the first pattern produces a relatively small amount of specular reflection compared with diffused reflection, while the second pattern produces a relatively large amount of specular reflection compared with diffused reflection, upon irradiation with light emitted by the light-emitting unit.

6. The image forming apparatus according to claim 5, wherein the predetermined threshold value that correlates with the surface condition of the pattern forming member includes a number of times the landing position error detecting pattern is formed on the pattern forming member.

7. The image forming apparatus according to claim 5, wherein the predetermined threshold value that correlates with the surface condition of the pattern forming member includes a number of media on which an image is formed by the image forming apparatus.

8. The image forming apparatus according to claim 5, wherein the predetermined threshold value that correlates with the surface condition of the pattern forming member includes a duration of time of use of the image forming apparatus.

9. The image forming apparatus according to claim 5, wherein the pattern forming member includes a transport belt configured to transport a medium, and wherein the predetermined threshold value that correlates with the surface condition of the pattern forming member includes an amount of rotation of the transport belt.

10. The image forming apparatus according to claim 1, wherein the first pattern and the second pattern have the same individual droplet amount and different arrangements.

11. The image forming apparatus according to claim 1, wherein the first pattern and the second pattern have the same arrangement and different individual droplet amounts.

12. A method for correcting a landing position of a droplet discharged out of a recording head, the method comprising the steps of:

detecting a surface condition of a region of a pattern forming member where a landing position error detecting pattern is formed;

forming a first pattern or a second pattern on the pattern forming member as the landing position error detecting pattern depending on the surface condition of the pattern-formed region of the pattern forming member detected in the detecting step, wherein the first pattern produces a relatively small amount of specular reflection compared to diffused reflection, while the second pattern produces a relatively large amount of specular reflection compared with diffused reflection, upon irradiation with light;

reading the landing position error detecting pattern formed on the pattern forming member; and correcting a landing position error of the droplet discharged out of the recording head based on a result of reading the landing position error detecting pattern in the reading step.

* * * * *